US008721228B2

(12) United States Patent
Suematsu et al.

(10) Patent No.: US 8,721,228 B2
(45) Date of Patent: May 13, 2014

(54) FOUNDATION-UNIT STRUCTURE OF STRUCTURAL OBJECT SUCH AS RETAINING WALL, STRUCTURE OF UPPER AND LOWER BOUNDARIES OF RETAINING WALL, AND RETAINING WALL

(75) Inventors: Yoshio Suematsu, Maebaru (JP); Toshimitsu Komatsu, Kasuya-gun (JP); Noriyuki Yasufuku, Fukuoka (JP)

(73) Assignee: Toeishokou Kabushi Kaisha, Fukuoka (JP)

( * ) Notice: Subject to any disclaimer, the term of this patent is extended or adjusted under 35 U.S.C. 154(b) by 1094 days.

(21) Appl. No.: 12/449,908

(22) PCT Filed: Mar. 3, 2008

(86) PCT No.: PCT/JP2008/053788

§ 371 (c)(1), (2), (4) Date: Sep. 2, 2009

(87) PCT Pub. No.: WO2008/108342

PCT Pub. Date: Sep. 12, 2008

(65) Prior Publication Data

US 2010/0129163 A1 May 27, 2010

(30) Foreign Application Priority Data

Mar. 2, 2007 (JP) ..... 2007-053367
Sep. 21, 2007 (JP) ..... 2007-246027

(51) Int. Cl.
*E02D 29/02* (2006.01)

(52) U.S. Cl.
USPC ..... 405/284

(58) Field of Classification Search
USPC ..... 405/262, 284, 286
See application file for complete search history.

(56) References Cited

U.S. PATENT DOCUMENTS

| | | | | |
|---|---|---|---|---|
| 4,521,138 | A * | 6/1985 | Steiner | 405/284 |
| 4,930,939 | A * | 6/1990 | Jaecklin | 405/262 |
| 4,964,761 | A * | 10/1990 | Rossi | 405/286 |

FOREIGN PATENT DOCUMENTS

| | | | |
|---|---|---|---|
| FR | 2828901 | A1 * | 2/2003 |
| JP | 58156636 | A * | 9/1983 |
| JP | 61-146923 | | 7/1986 |
| JP | 6-207417 | | 7/1994 |
| JP | 8-226135 | | 9/1996 |
| JP | 2669797 | | 7/1997 |
| JP | 11-81346 | | 3/1999 |
| JP | 2004-204669 | | 7/2004 |
| JP | 2005-171478 | | 6/2005 |
| WO | WO 2006021987 | A1 * | 3/2006 |

* cited by examiner

*Primary Examiner* — Sunil Singh
(74) *Attorney, Agent, or Firm* — Jordan and Hamburg LLP

(57) ABSTRACT

The present invention provides a foundation-unit structure of a structural object such as a retaining wall installed fixedly on a foundation ground, in which the foundation ground is formed therein with a concavity, a sliding resistive element is placed within the concavity, and at least the front surface side of the sliding resistive element is filled with a grain-sized material so as to form a layer thereof, and an internal frictional angle of the grain-sized material forming the grain-sized material layer is equal to or greater than that of a grain-sized material comprising the ground and supporting the grain-sized material layer, and the grain-sized material layer exerts a reaction force (passive) via the sliding resistive element so as to reinforce a sliding resistance of the structural object mounted on the grain-sized material layer. In this way, a retaining wall excellent in a sliding preventive function is provided.

4 Claims, 23 Drawing Sheets

Fig. 5 (1)
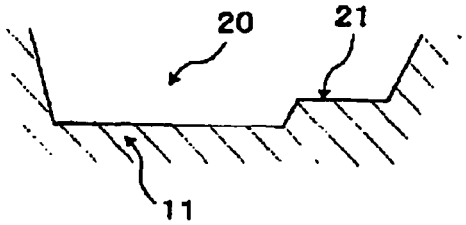
Fig. 5 (2)
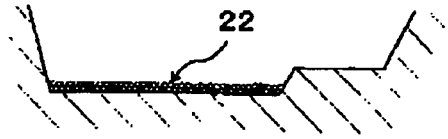
Fig. 5 (3)
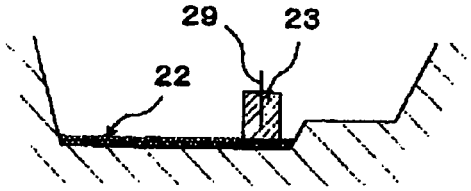
Fig. 5 (4)
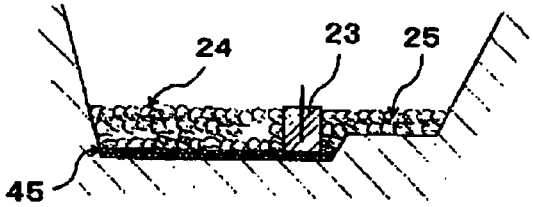
Fig. 5 (5)
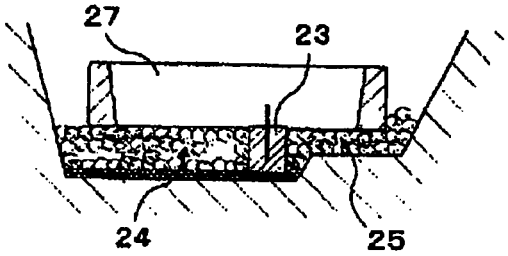
Fig. 5 (6)
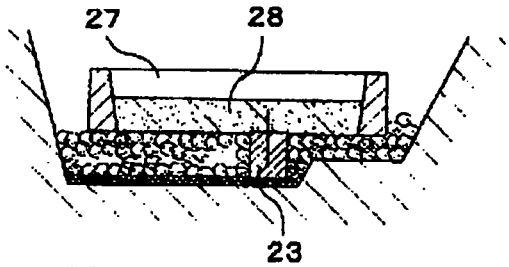
Fig. 5 (7)
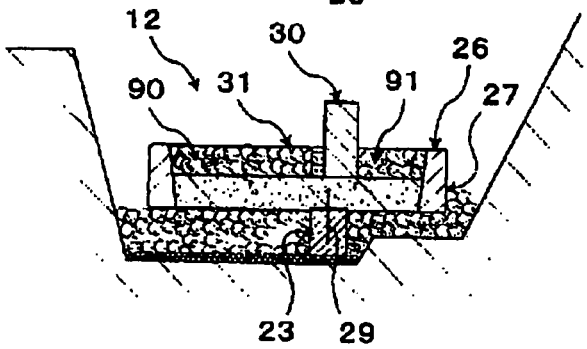

Fig. 5 (8)
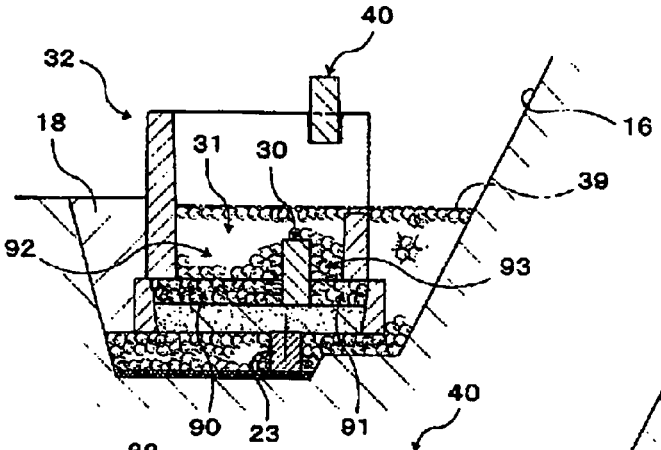
Fig. 5 (9)
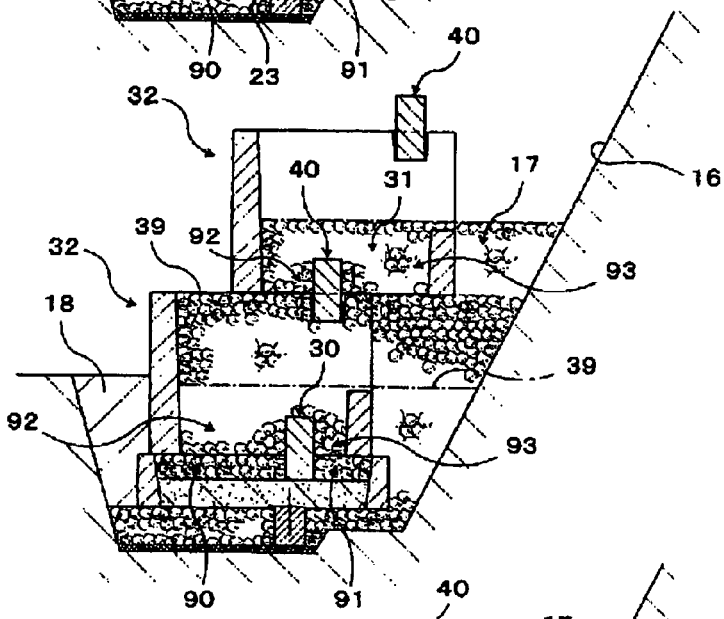
Fig. 5 (10)
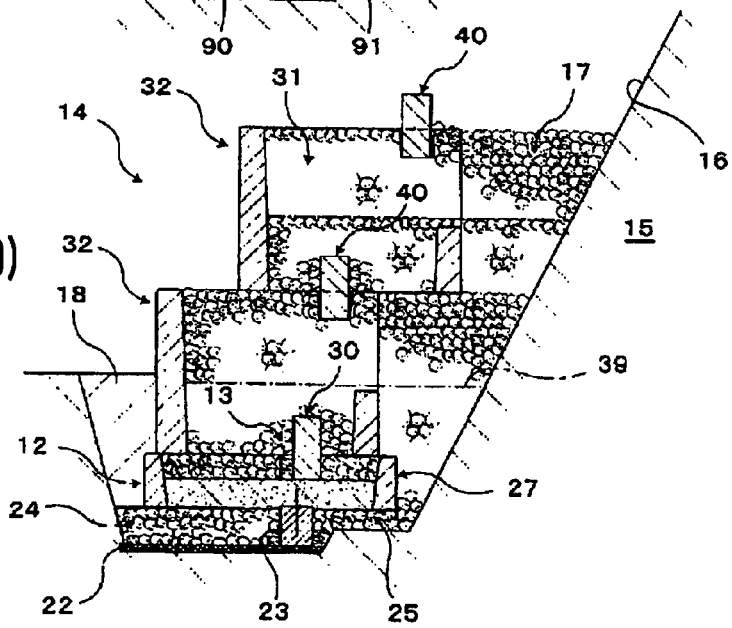

Fig. 6 (5')
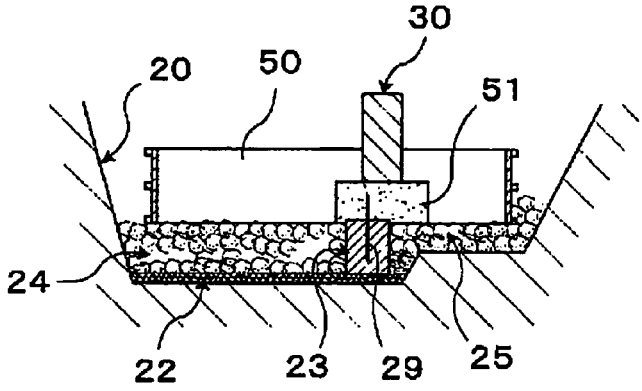
Fig. 6 (6')
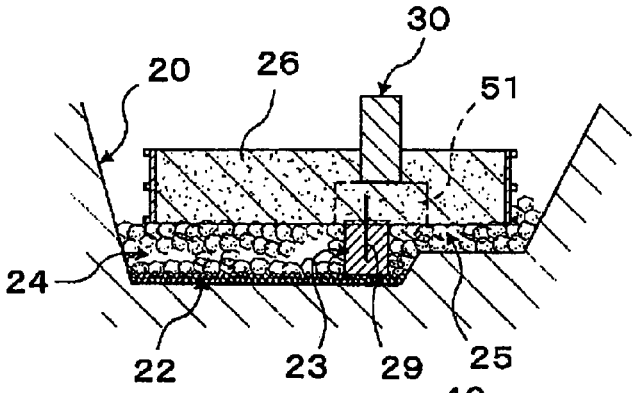
Fig. 6 (7')
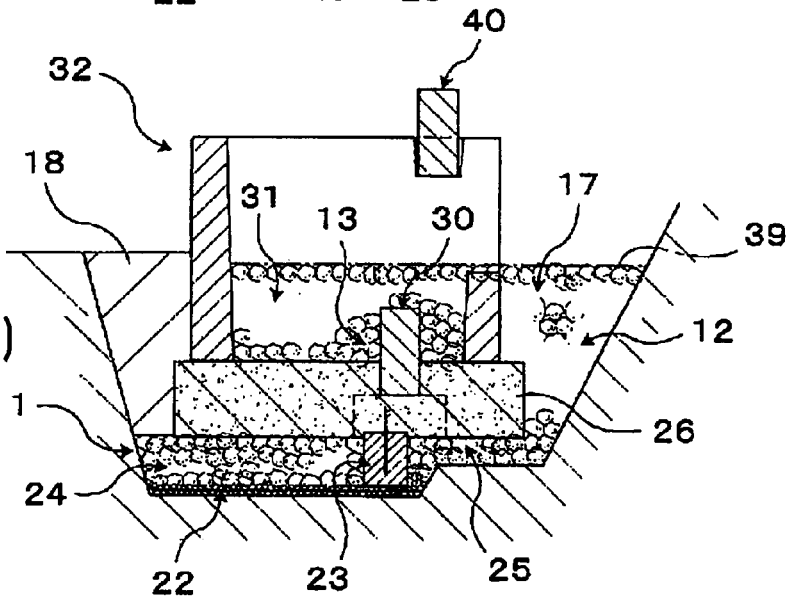

FOUNDATION-UNIT STRUCTURE OF STRUCTURAL OBJECT SUCH AS RETAINING WALL, STRUCTURE OF UPPER AND LOWER BOUNDARIES OF RETAINING WALL, AND RETAINING WALL

BACKGROUND OF THE INVENTION

The present invention relates to a foundation unit of structural objects such as a retaining wall (a dry-walled retaining wall, an L-shaped retaining wall, etc.), upper and lower boundaries of retaining walls, and a structure for preventing sliding of retaining walls.

As one mode of a retaining wall, there is that which is formed by disposing a foundation unit on a ground and fixedly installing a retaining wall unit on the foundation unit.

In such a retaining wall, a sliding force caused by a horizontal external force such as an earth pressure is counteracted by a shear resistance ($\Sigma V \times \tan \phi$) occurring between the lower surface of the foundation unit and the top surface of the ground. Thus, generally, the width of the foundation unit is appropriately calculated to secure the safety.

Then, when it is postulated such that "a rigid ground or base rock is provided, or the adhesion with the surrounding grounds is to be secured without disturbing the ground", and in under this condition, a protruding sliding resistive element is arranged on the lower surface of the foundation unit. In this way, it may become possible to respond to a construction site where the width of the foundation unit cannot be widened.

For example, there is a prior technology such that on the lower surface of a basement, which is a foundation unit of an L-shaped retaining wall, a separately-formed sliding resistive element is installed consecutively to implement sliding prevention of the retaining wall (for example, see Patent Document 1). That is, when constructing such an L-shaped retaining wall, a groove for embedding the sliding resistive element is excavated to be formed on the ground, and the sliding resistive element that is previously formed as a precast concrete is fit and placed into that groove. In this way, the sliding resistive element is integrally installed consecutively of the basement of the L-shaped retaining wall.

At this time, in the groove for embedding the sliding resistive element, a part of the ground is excavated so as to prepare a size that can facilitate fitting of the sliding resistive element therein, and after placing the sliding resistive element in the groove, a filling material such as crushed stone is filled in a gap formed between front and back walls of the groove and the sliding resistive element.

In this way, the sliding resistive element is caused to exert a passive earth pressure thereby to increase the sliding resistance of the retaining wall.

Moreover, at a retaining wall unit formed by stacking one above another a plurality of retaining wall blocks on the foundation unit, a pair of left and right rod-shaped slide preventive pieces are upwardly projected in left and right side portions of an upper-end surface front portion of the foundation unit, and left and right side portions of a front-wall lower portion of the retaining wall block forming the lowest level is caused to touch the both slide preventive pieces, thereby preventing the retaining wall block from sliding forwardly.

Moreover, also in left and right side portions of an upper-end-surface front portion of each retaining wall block, a pair of left and right rod-shaped slide preventive pieces are upwardly projected, and the left and right side portions of the front-wall lower portion of the retaining wall block adjacent to the upper level are caused to touch the both slide preventive pieces. In this way, forward sliding of each retaining wall block is prevented (for example, see Patent Document 2).

Patent Document 1: Japanese Patent No. 2669797

Patent Document 2: Japanese Unexamined Patent Application Publication No. 2004-204669

DISCLOSURE OF THE INVENTION

Problem to be Solved by the Invention (1) The retaining wall in the above-described Patent Document 1 has the following problems:

That is, a procedure for an earth work in which the sliding resistive element is arranged requires a double excavation, i.e., the ground is firstly excavated in a concave shape, and thereafter, a dedicated embedding space that matches the size of the sliding resistive element is excavated again.

At this time, the inner-surface wall of the groove, which is the embedding space, and a horizontal portion near the groove are difficult to sufficiently compact, and thus, it is not possible to sufficiently secure the adhesion with the surrounding grounds.

Because of this, an engineering characteristic function as a ground material provided inherently in the ground is decreased, and as a result, the preceding precondition of "without disturbing the ground" is contradicted.

Further, when the rigid ground, which is the precondition, is not available, in a viscous ground of which the internal friction angle is small and the drainage is poor, in particular, even when the sliding resistive element is arranged on the foundation bottom surface as described above, intensification of the sliding resistance is not realized.

(2) The retaining wall in the above-described Patent Document 2 has the following problems:

That is, in the retaining wall in which a pair of left and right rod-shaped sliding preventive pieces are upwardly projected in the left and right side portions of the upper-end-surface front portion of the retaining wall block, the left and right side portions of the front-wall lower portion of the retaining wall block adjacent to the upper level are caused to touch the both sliding preventive pieces, thereby preventing each retaining wall block from sliding forwardly, when the external force acted on each retaining wall block is greater, the effect as the sliding preventive piece is exerted. However, at the same time, the stress is concentrated on the slide preventive pieces and the surrounding portions supporting these pieces, and thereby, a local destruction is generated. Thus, naturally, there is a limit on the effect of these sliding preventive pieces.

Moreover, in a curve construction, radius of curvature of an arch differs depending on each step, and thus, there arises the following defect: when the retaining wall blocks are seamlessly arranged continuously, the front-wall lower portion of the upper-level retaining wall block cannot be caused to touch both pair of left and right sliding preventive pieces arranged in the retaining wall block.

Therefore, in the curve construction, it is physically difficult to lay down the retaining wall blocks in a seamless, continuos manner.

Means for Solving the Problem (1) The present invention according to a first aspect thereof is a foundation-unit structure of a structural object such as a retaining wall installed fixedly on a foundation ground, wherein the foundation ground is formed therein with a concave unit, a sliding resistive element is placed within the concave unit, and at least a front surface side of the sliding resistive element is filled with a grain-sized material so as to form a grain-sized material layer, and at the same time, an internal frictional angle of the grain-sized material forming the grain-sized material layer has a degree equal to or more than that of an originally used ground material supporting the grain-sized material layer, and the grain-sized material layer exerts a reaction force (passive) via the sliding resistive element so as to reinforce a sliding resistance of the structural object mounted on the grain-sized material layer.

(2) The present invention according to a second aspect thereof is the foundation-unit structure of a structural object according to the first aspect of the invention, wherein on the grain-sized material layer, a block provided at least with front and back walls and a link body for linking the both front and back walls is placed, and at the same time, an upper portion of the sliding resistive element is placed to lengthen above the grain-sized material layer between the front and back walls of the block, front and back spaces are formed respectively between the upper portion of the sliding resistive element and the front and back walls of the block, a constraining-layer forming material is filled in each of the front and back spaces to from the front and rear constraining layers, thereby allowing at least the front constraining layer and the grain-sized material layer to continue in up and down directions, and as a result, the front constraining layer and the grain-sized material layer continued in up and down directions via the sliding resistive element exert a reaction force (passive), whereby a sliding resistance of the block mounted on the grain-sized material layer is reinforced.

(3) The present invention according to a third aspect thereof is a foundation-unit structure of a structural object such as a retaining wall installed fixedly on a foundation ground, wherein the foundation ground is formed therein with a concave unit, a sliding resistive element is placed within the concave unit, and at least a front surface side of the sliding resistive element is filled with a grain-sized material so as to form a grain-sized material layer, and at the same time, an internal frictional angle of the grain-sized material forming the grain-sized material layer has a degree equal to or more than that of an originally used ground material supporting the grain-sized material layer, and on the grain-sized material layer, a block that is provided at least with front and back walls and a link body for linking the both front and back walls and that forms one portion of the foundation unit or the structural object is placed, a solidification material is injected and solidified within the block so as to integrate the block and the sliding resistive element, whereby the grain-sized material layer is caused to exert a reaction force (passive) to the sliding resistive element integrated with the block.

(4) The present invention according to a fourth aspect thereof is a foundation-unit structure of a structural object such as a retaining wall installed fixedly on a foundation ground, wherein the foundation ground is formed therein with a concave unit, a sliding resistive element is placed within the concave unit, and at least a front surface side of the sliding resistive element is filled with a grain-sized material so as to form a grain-sized material layer, and at the same time, an internal frictional angle of the grain-sized material forming the grain-sized material layer has a degree equal to or more than that of an originally-used ground material supporting the grain-sized material layer, and a solidification material is solidified on the grain-sized material layer so as to form a solidified organizer integrated with the sliding resistive element, whereby the grain-sized material layer is caused to exert a reaction force (passive) to the sliding resistive element integrated with the solidified organizer.

(5) The present invention according to a fifth aspect thereof is a structure of upper and lower boundaries of a retaining wall so constructed that a foundation unit is disposed on a foundation ground and a retaining wall unit is installed fixedly on the foundation unit, the retaining wall, wherein a block forming one portion of the foundation unit or each block formed by stacking the retaining wall units one above another is provided at least with front and back walls and a link body for linking the both front and back walls, at positions of upper and lower boundary surfaces of the respective upper and lower-level blocks formed by stacking one above another, a sliding resistive element is placed over the lower-level block side and upper-level block side, in a space formed between a front wall of the lower-level block and a portion of the sliding resistive element on the lower-level block side, a constraining-layer forming material is filled to form a front constraining layer on a lower level side, and at the same time, in a space formed between the portion of the sliding resistive element on the lower-level block side and a slope formed at the back wall of the lower-level block or at the back of the retaining wall unit, the constraining-layer forming material is filled so as to form a rear constraining layer on a lower-level side, whilst in a space formed between the front wall of the upper-level block and the portion of the sliding resistive element on the upper-level block side, the constraining-layer forming material is filled to form a front constraining layer on the upper-level side, and at the same time, in a space formed between the portion of the sliding resistive element on the upper-level block side and the back wall of the upper-level block, the constraining-layer forming material is filled to form a rear constraining layer on the upper-level side, thereby allowing the upper and lower-level front constraining layers to continue in up and down directions at positions of upper and lower boundary surfaces of the upper and lower-level blocks, and at the same time, allowing the upper and lower-level rear constraining layers to continue in up and down directions, whereby the front constraining layer continued in up and down directions and the rear constraining layer continued in up and down directions are caused to exert a reaction force (passive) via the sliding resistive element, thereby reinforcing a sliding resistance of the blocks on the upper and lower boundary surfaces.

(6) The present invention according to a sixth aspect thereof is the structure of upper and lower boundaries of a retaining wall according to the fifth aspect of the invention, wherein the sliding resistive element is placed with the block in a non-linking state.

(7) The present invention according to a seventh aspect thereof is the structure of upper and lower boundaries of a retaining wall according to the fifth aspect of the invention, wherein the sliding resistive element is placed in the lower-level block, out of the upper and lower-level blocks adjacent in the up and down directions, in a linking state.

(8) The present invention according to an eighth aspect thereof is the structure of upper and lower boundaries of a retaining wall according to the seventh aspect of the invention, wherein in the sliding resistive element, a fitting-use concave unit is arranged for fitting the link body for linking the front and back walls of the block to an end of the sliding resistive element, and via the fitting-use concave unit, the sliding resistive element is placed in a laterally disposed manner.

(9) The present invention according to a ninth aspect thereof is a retaining wall so constructed that a foundation unit is disposed on a foundation ground and a retaining wall unit is installed fixedly on the foundation unit, the retaining wall, wherein at positions of upper and lower boundary surfaces of respective upper and lower-level blocks formed by stacking one above another, on the block according to the second aspect of the invention, separate blocks each provided at least with front and back walls and a link body for linking the both front and back walls, a sliding resistive element is placed over a lower-level block side and an upper-level block side, in a space formed between a front wall of the lower-level block and a portion of the sliding resistive element on the lower-level block side, a constraining-layer forming material is filled to form a front constraining layer on a lower level side, and at the same time, in a space formed between the portion of the sliding resistive element on the lower-level block side and a slope formed behind the lower-level block or at the back of the retaining wall unit, the constraining-layer forming material is filled so as to form a lower-level-side rear constraining layer, whilst in a space formed between the front wall of the upper-level block and the portion of the sliding resistive element on the upper-level block side, a constraining-layer forming material is filled to form an upper-level side front constraining layer, and at the same time, in a space formed between the portion of the sliding resistive element on the upper-level block side and the back wall of the upper-level block, the constraining-layer forming material is filled to form an upper-level-side rear constraining layer, thereby allowing the upper and lower-level front constraining layers to continue in up and down directions at positions of upper and lower boundary surfaces of upper and lower-level blocks, and at the same time, allowing the upper and lower-level rear constraining layers to continue in up and down directions, whereby the front constraining layer continued in up and down directions and the rear constraining layer continued in up and down directions are caused to exert a reaction force (passive) via the sliding resistive element, thereby reinforcing a sliding resistance of the blocks on the upper and lower boundary surfaces.

(10) The present invention according to a tenth aspect thereof is the retaining wall according to any one of the first to ninth aspects of the invention, wherein left and right widths of an upper portion of the sliding resistive element are formed to be equal to, or narrower than, left and right widths of a lower portion of the sliding resistive element.

(11) The present invention according to an eleventh aspect thereof is the retaining wall according to any one of the first to ninth aspects of the invention, wherein the sliding resistive elements, which are linked in intervals in front and back directions, have an upper portion of at least one of the sliding resistive elements being formed in an upwardly lengthening manner, and in a space formed between the opposing sliding resistive elements, a grain-sized material or a constraining-layer forming material is filled so as to form the grain-sized material layer or the constraining layer.

(12) The present invention according to a twelfth aspect thereof is the retaining wall according to the ninth aspect thereof, wherein the sliding resistive element placed at upper and lower boundary surfaces of the blocks is linked with a distal end a ribbon-shaped anchorage, and a leading end of the anchorage is lengthened substantially horizontally in a ground formed behind the retaining wall unit, thereby bringing the anchorage in a state of being embedded in the ground behind the retaining wall.

Effects of the Invention (1) The present invention according to the first aspect thereof is a foundation-unit structure of a structural object such as a retaining wall installed fixedly on a foundation ground. The foundation ground is formed therein with a concave unit, a sliding resistive element is placed within the concave unit, and at least a front surface side of the sliding resistive element is filled with a grain-sized material so as to form a grain-sized material layer, and at the same time, an internal frictional angle of the grain-sized material forming the grain-sized material layer has a degree equal to or more than that of an originally used ground material supporting the grain-sized material layer, and the grain-sized material layer exerts a reaction force (passive) via the sliding resistive element so as to reinforce a sliding resistance of the structural object mounted on the grain-sized material layer. Herein, the concave unit includes, not limited to a shape of which the cross section is a substantial U-letter, a shape of which the cross section is a substantial L-letter.

In the conventional technology where a space dedicated to a protrusion is arranged, the foundation ground is excavated double, and thus, the ground is disturbed and the adhesion provided between the protrusion and the surrounding grounds is lowered. Moreover, in a viscous ground or any other similar ground of which the internal frictional angle is small, a coefficient (value) of the passive earth pressure is small, and thus, it is difficult to secure an effective, highly efficient passive earth pressure.

The present invention greatly differs from the conventional technology in which the groove dedicated to a protrusion is excavated in that the dedicated groove or embedded space of the sliding resistive element is not formed. That is, the present invention lies in holding a foundation ground without impairing the physical characteristic originally provided in the ground as much as possible by lessening the disturbance of the ground through elimination of excavation of the embedded space dedicated to the protrusion.

Moreover, the grain-sized material having an internal frictional angle larger than that of a viscous soil, etc., is used as the material within the concave unit. A grain-sized material layer capable of exerting a greater passive earth pressure is thereby formed, and the grain-sized material layer exerts an effective, highly efficient reaction force (passive) via the sliding resistive element, whereby the sliding resistance of a structural object mounted on the grain-sized material layer can be reinforced.

Specifically, the foundation ground is excavated and rolling-compacted thereby to form the concave unit, the sliding resistive element is placed within the concave unit, and at least front surface side of the sliding resistive element is rolling-compacted and filled with the grain-sized material, thereby forming the grain-sized material layer.

At this time, the precondition is that the internal frictional angle of the grain-sized material forming the grain-sized material layer has a degree equal to or more than that of the originally used ground material supporting the grain-sized material layer. For example, in a case of a cobble, the cobble has an internal frictional angle larger than that of a clay or a sandy soil, and thus, the cobble exerts a shearing force larger than that of the clay or the sandy soil, and as a result, the cobble exerts a passive earth pressure in accordance with the internal frictional angle of the cobble. Moreover, in a clay-ground, drainage is poor, and thus, an effective stress is lowered under a non-drained condition, and the shearing force and the passive earth pressure are further reduced. However, the cobble, which excels in drainage, can exert a stable passive earth pressure.

In this way, the present invention is so configured that the dedicated groove for embedding the sliding resistive element is eliminated, the sliding resistive element is arranged on the foundation ground, and at least the grain-sized material having an internal frictional angle larger than that of the originally used ground material is used on at least front surface side of the sliding resistive element, thereby forming a grain-sized material layer capable of exerting a greater passive earth pressure (coefficient). Thereby, the grain-sized material layer exerts an effective passive earth pressure as a reaction force via the sliding resistive element, whereby the sliding resistance of the structural object mounted on the grain-sized material layer is reinforced.

(2) In the present invention according to the second aspect thereof, on the grain-sized material layer, a block provided at least with front and back walls and a link body for linking the both front and back walls is placed, and at the same time, an upper portion of the sliding resistive element is placed to lengthen above the grain-sized material layer between the front and back walls of the block, front and back spaces are formed between the upper portion of the sliding resistive element and the front and back walls of the block, respectively, a constraining-layer forming material is filled in each of the front and back spaces to form front and rear constraining layers, thereby allowing at least the front constraining layer and the grain-sized material layer to continue in up and down directions, and as a result, the front constraining layer and the grain-sized material layer continued in up and down directions via the sliding resistive element exert a reaction force (passive), whereby a sliding resistance of the block mounted on the grain-sized material layer is reinforced.

The block used herein is that which, positioned at the lowest level, forms one portion of the foundation unit or the retaining wall. Moreover, the constraining-layer forming material is a sandbag formed by filling a grain-sized material, a precast plate, a ready-mixed concrete, a gravel, a crushed stone, or any other similar material, or formed by using these substances in combination.

Therefore, when the active earth pressure is acted on the block placed on the grain-sized material layer, the active earth is propagated from the back wall of the block to the sliding resistive element by way of the rear constraining layer formed in between with the upper portion of the sliding resistive element. By this propagation, the constraining-layer forming materials respectively forming the front constraining layer continued in up and down directions on the front surface side of the sliding resistive element and the grain-sized material layers, and the grain-sized material exert a reaction force (passive) via the sliding resistive element, thereby reinforcing the sliding resistance toward the front direction of the block placed on the grain-sized material layer, i.e., the lowest-level block loaded on the grain-sized material layer.

At this time, a dry masonry structure of non-linkage system is achieved in which the sliding resistive element is installed separately of (rather than being linked with) the block, and a grain-sized material is filled in a space formed by the sliding resistive element and the block thereby to surround the whole periphery of the sliding resistive element with the grain-sized material. Therefore, the sliding resistive element will not experience the generation of warpage, tension, shear stress, etc., which would otherwise lead to destruction. Thus, fundamentally, the sliding resistive element is not destructed. Note that in a conventional construction method in which the protrusion and the foundation unit are integrated, large stress such as warpage, tension, and shearing is generated in the protruded portion, and thus, a troublesome design and building construction are required, resulting in an inevitable cost increase.

Moreover, the effective area of the sliding resistive element that exerts the reaction force is not reduced, and thus, it is possible to exert a reaction force (passive) larger than that of a sliding resistive element of integrated/fixed type.

In the present invention, between left and right cross-sectional surfaces of the sliding resistive element and the link body of the block, left and right spaces can be formed. These left and right spaces are filled with the constraining-layer forming material, thereby enabling the formation of the left and right side constraining layers. In this way, the constraining layers exert a reaction force via the sliding resistive element, on the external force from left and right directions in the event of an earthquake, etc. This enables the prevention of sliding in left and right directions of the block.

(3) The present invention according to the third aspect thereof is a foundation-unit structure of a structural object such as a retaining wall installed fixedly on a foundation ground, wherein the foundation ground is formed therein with a concave unit, a sliding resistive element is placed within the concave unit, and at least a front surface side of the sliding resistive element is filled with a grain-sized material so as to form a grain-sized material layer, and at the same time, an internal frictional angle of the grain-sized material forming the grain-sized material layer has a degree equal to or more than that of an originally used ground material supporting the grain-sized material layer, and on the grain-sized material layer, a block that is provided at least with front and back walls and a link body for linking the both front and back walls and that forms one portion of the foundation unit or the structural object is placed, a solidification material is injected and solidified within the block so as to integrate the block and the sliding resistive element, whereby the grain-sized material layer is caused to exert a reaction force (passive) to the sliding resistive element integrated with the block.

In this case, as the block, a precast concrete block is used, for example, and as the solidification material, a cast in-situ concrete can be used, for example.

In this way, with respect to the block placed on the grain-sized material layer and the sliding resistive element are integrated, a solidification material is injected within the block for a purpose of solidification, and thereby, the sliding resistive element is integrated with the block.

Therefore, when the active earth pressure is acted on the block placed on the grain-sized material layer, the active earth pressure is propagated to the sliding resistive element integrated with the block. By the propagation, the grain-sized material forming the grain-sized material layer exerts a reaction force (passive) on the sliding resistive element, thereby preventing the sliding of the block placed on the grain-sized material layer.

(4) The present invention according to the fourth aspect thereof is a foundation-unit structure of a structural object such as a retaining wall installed fixedly on a foundation ground, wherein the foundation ground is formed therein with a concave unit, a sliding resistive element is placed within the concave unit, and at least a front surface side of the sliding resistive element is filled with a grain-sized material so as to form a grain-sized material layer, and at the same time, an internal frictional angle of the grain-sized material forming the grain-sized material layer has a degree equal to or more than that of an originally-used ground material supporting the grain-sized material layer, and a solidification material is solidified on the grain-sized material layer so as to form a solidified organizer integrated with the sliding resistive element, whereby the grain-sized material layer is caused to exert a reaction force (passive) to the sliding resistive element integrated with the solidified organizer.

In this way, the solidified organizer forming the foundation unit or one portion of the retaining wall unit, and the sliding resistive element are integrated.

Therefore, when the solidified organizer is placed on the grain-sized material layer and the active earth pressure is acted thereon, the active earth pressure is propagated to the sliding resistive element integrated with the solidified organizer. By this propagation, the grain-sized material forming the grain-sized material layer exerts an effective reaction force (passive) on the sliding resistive element, thereby preventing the sliding of the solidified organizer placed on the grain-sized material layer.

Note that the solidified organizer, as a solidification material, can be formed by solidifying a cast in-situ concrete, for example.

(5) In the present invention according to the fifth aspect thereof, in a retaining wall so constructed that a foundation unit is disposed on a foundation ground and a retaining wall unit is installed fixedly on the foundation unit, the retaining wall, wherein a block forming one portion of the foundation unit or each block formed by stacking the retaining wall units one above another is provided at least with front and back walls and a link body for linking the both front and back walls, at positions of upper and lower boundary surfaces of the respective upper and lower-level blocks formed by stacking one above another, a sliding resistive element is placed over the lower-level block side and upper-level block side, in a space formed between a front wall of the lower-level block and a portion of the sliding resistive element on the lower-level block side, a constraining-layer forming material is filled to form a front constraining layer on a lower level side, and at the same time, in a space formed between the portion of the sliding resistive element on the lower-level block side and a slope formed at the back wall of the lower-level block or behind the retaining wall unit, the constraining-layer forming material is filled so as to form a rear constraining layer on a lower-level side, whilst in a space formed between the front wall of the upper-level block and the portion of the sliding resistive element on the upper-level block side, the constraining-layer forming material is filled to form a front constraining layer on the upper-level side, and at the same time, in a space formed between the portion of the sliding resistive element on the upper-level block side and the back wall of the upper-level block, the constraining-layer forming material is filled to form a rear constraining layer on the upper-level side, thereby allowing the upper and lower-level front constraining layers to continue in up and down directions at positions of upper and lower boundary surfaces of the upper and lower-level blocks, and at the same time, allowing the upper and lower-level rear constraining layers to continue in up and down directions, whereby the front constraining layer continued in up and down directions and the rear constraining layer continued in up and down directions are caused to exert a reaction force (passive) via the sliding resistive element, thereby reinforcing a sliding resistance of the blocks on the upper and lower boundary surfaces. Herein, the slope is a land at the back of the retaining wall such as a cut plane of a bedrock and an inclined place of embankment.

Therefore, when the active earth pressure is acted on the block, the active earth pressure is propagated, by way of the rear constraining-layer forming material forming the back wall and/or the rear constraining layer of the block, to the sliding resistive element. By this propagation, the both front constraining-layer forming materials, positioned on the front surface side of the sliding resistive element, continued in up and down directions exert a reaction force (passive) on the sliding resistive element, thereby preventing the sliding in a front direction of the block on the upper and lower boundary surfaces.

Moreover, when an external force (earthquake) opposite in direction to the active earth pressure is acted on the block, the external force is propagated, from the front wall of the block, by way of the constraining-layer forming material forming the front constraining layer, to the sliding resistive element. Against this propagated external force from the front direction, the upper and lower-level rear-constraining-layer forming materials, positioned on the rear surface side of the sliding resistive element, continued in up and down directions exert a reaction force (passive) on the sliding resistive element, thereby preventing the sliding in a back direction of the block on the upper and lower boundary surfaces.

Moreover, separately of the front and rear spaces formed between the front and back surfaces of the sliding resistive element and the front and back walls of the block, the left and right spaces are formed between the left and right cross-sectional surfaces of the sliding resistive element and the linking body of the block, and the constraining-layer forming material is filled in the both spaces, thereby enabling the formation of the left and right side constraining layers. In this state, the left and right side constraining layers exert a reaction force in left and right directions via the sliding resistive element, against the external force (earthquake, etc.) from the left and right directions, thereby preventing the sliding in left and right directions of the block.

In this way, by the reaction force (passive) exerted, on the sliding resistive element, by the front, back, left, and right constraining-layer forming materials via the sliding resistive element, the sliding of the block of the upper and lower boundaries at each level in front, back, left and right directions is prevented. Thereby, the sliding resistance in a two-dimensional (plan surface to 360 degrees) direction can be reinforced.

Moreover, the sliding preventive structure in which the sliding resistance between the blocks is reinforced by causing the constraining-layer forming material to exert the reaction force via the sliding resistive element is affected by the weight of each constraining-layer forming material acted on the sliding resistive element, an earth covering pressure acted on the constraining-layer forming material, and any other similar factor. Therefore, a steeper slope so formed that the earth covering pressure of an internally filled material is inevitably increased when a deviation width in a far-side direction of blocks stacked one above another is more lessened can exert a greater reaction force (passive). That is, it is possible to achieve an ideal sliding preventive structure in which the steeper the slope, the more reinforced the sliding resistance.

(6) In the present invention according to the sixth aspect thereof, the sliding resistive element is placed so that it is in a state of being non-linking with the block.

In this way, a dry-masonry structure of non-linkage system is achieved in which the sliding resistive element is installed to be spaced at a certain interval of (i.e., rather than being linked with) the block, and a grain-sized material is filled in a space formed between the sliding resistive element and the block thereby to surround the whole periphery of the sliding resistive element with the grain-sized material. Therefore, the sliding resistive element will not experience the generation of warpage, tension, shear stress, etc., that would otherwise lead to the destruction, and thus, fundamentally, the sliding resistive element is not destructed.

In this regard, in a conventional projection construction method in which the projection and the block are linked, the lower portion of a block front surface is brought into contact with a projection surface, thereby resisting the sliding of the block by the shearing force of the projection. However, when an external force of a predetermined value or higher is acted, warpage, tension, shear stress, etc., are generated, and as a result, the projected portion is impaired, thereby greatly decreasing the safety of the retaining wall. Moreover, a direction in which the sliding resistance of the block can be exerted by using these projections is a front direction only, and there is no effect of the projections toward an external force from left and right directions. Thus, from the both ends of the block, the internally filled material may sometimes be come out. As described above, the conventional construction method in which the projection is linked to the block has problems in terms of bearing force and functionability.

(7) In the present invention according to the seventh aspect thereof, the sliding resistive element is so placed that it is linked to a lower-level block, out of upper and lower-level blocks adjacent in up and down directions.

Herein, "so placed that it is linked to a block" used in the present invention may include the following cases: where the position of disposing the sliding resistive element relative to the block can be substantially positioned (with a play in front and back directions) by fitting the end of the constrained unit to the fitting-use concave unit formed in the block for a purpose of linking or engaging the end of the constrained unit with the engaging-use projection arranged in the block for a purpose of linking; where the constrained unit is linked to the block in a fixed state via a linking tool such as a linking bolt; and where the block is integrally molded with the sliding resistive element so as to achieve a state in which the block is integrally linked to the constrained unit.

Therefore, when the sliding resistive element is placed by bringing it in a state of being linked to the lower-level block, out of the upper and lower-level blocks adjacent in up and down directions, the following can be said in view of structure: the weight of the sliding resistive element and the weight of the internally filled material loaded on the sliding resistive element are propagated to the lower-level block via the sliding resistive element, the weight in a vertical direction of the block is increased, and at the same time, because of the increase in lower-portion area of the sliding resistive element, the shearing strength (vertical component) of the constraining-layer forming material is increased. As a result, because the weight and the shearing strength of these are increased, the reaction force against the external force in a vertical direction is increased, thereby enabling contribution to the stability of the retaining wall.

(8) In the present invention according to the eighth aspect thereof, in the sliding resistive element, the fitting-use concave unit for fitting the end of the sliding resistive element to the link body for linking the front and back walls of the block is arranged, and the sliding resistive element is placed in a laterally disposed manner via the fitting-use concave unit.

Therefore, in view of a building construction, when the end of the sliding resistive element is simply fitted to the fitting-use concave unit so that the sliding resistive element is placed in a laterally disposed manner, the sliding resistive element can be placed (positioned) exactly and easily, and at the same time, it is possible to prevent a potential falling off of the sliding resistive element during the building construction.

(9) The present invention according to the ninth aspect thereof is a retaining wall so constructed that a foundation unit is disposed on a foundation ground and a retaining wall unit is installed fixedly on the foundation unit, the retaining wall, wherein at positions of upper and lower boundary surfaces of respective upper and lower-level blocks formed by stacking one above another, on the block according to the second aspect of the invention, separate blocks each provided at least with front and back walls and a link body for linking the both front and back walls, a sliding resistive element is placed over a lower-level block side and an upper-level block side, in a space formed between a front wall of the lower-level block and a portion of the sliding resistive element on the lower-level block side, a constraining-layer forming material is filled to form a front constraining layer on a lower level side, and at the same time, in a space formed between the portion of the sliding resistive element on the lower-level block side and a slope formed at the back wall of the lower-level block or behind the retaining wall unit, the constraining-layer forming material is filled so as to form a lower-level-side rear constraining layer, whilst in a space formed between the front wall of the upper-level block and the portion of the sliding resistive element on the upper-level block side, a constraining-layer forming material is filled to form an upper-level side front constraining layer, and at the same time, in a space formed between the portion of the sliding resistive element on the upper-level block side and the back wall of the upper-level block, the constraining-layer forming material is filled to form an upper-level-side rear constraining layer, thereby allowing the upper and lower-level front constraining layers to continue in up and down directions at positions of upper and lower boundary surfaces of upper and lower-level blocks, and at the same time, allowing the upper and lower-level rear constraining layers to continue in up and down directions, whereby the front constraining layer continued in up and down directions and the rear constraining layer continued in up and down directions are caused to exert a reaction force (passive) via the sliding resistive element, thereby reinforcing a sliding resistance of the blocks on upper and lower boundary surfaces.

Firstly, by using the foundation-unit structure according to claim 2 the second aspect of the invention, the sliding of the lowest-level block that receives the largest earth pressure is prevented. Then, at positions of upper and lower boundary surfaces between the lowest-level block and the block loaded on the lowest-level block, the sliding resistive element is placed over the lower-level block side and the upper-level block side so as to form the structure of upper and lower boundaries of the retaining wall, and at the same time, the structure of upper and lower boundaries is sequentially continued from the lowest-level block to the upper-level side, and thereby, the block at each level completes a series of sliding preventive structures in which lower-level side blocks sequentially prevent the sliding of upper-level side blocks.

Specifically, when the active earth pressure is acted on a block (lowest level) having the largest earth pressure, the active earth pressure is propagated to the sliding resistive element via the rear constraining layer formed between the back wall of the block (lowest level) and the upper portion of the sliding resistive element. By this propagation, the constraining-layer forming materials respectively forming the front constraining layer continued in up and down directions on the front surface side of the sliding resistive element and the grain-sized material layer, and the grain-sized material exert a reaction force (passive) via the sliding resistive element, thereby preventing the sliding of the block (lowest level). Of course, the active earth pressure is also acted on the block at each level higher than the block (lowest level), and these active earth pressures are propagated to the sliding resistive element by way of the back wall of the block at each level and/or the constraining-layer forming material forming the rear constraining layer. By this propagation, the both front constraining-layer forming materials continued in the up and down directions on the front surface side of the sliding resistive element exert a reaction force (passive) on the sliding resistive element. Thereby, the lower-level side block of the upper and lower boundaries prevents the sliding of the upper-level side block.

At this time, the upper the level, the smaller the active earth pressure. Thus, unless the lowest-level block having the largest active earth pressure is slid, the block at each level completes a series of sliding preventive structures in which lower-level side blocks sequentially prevent the sliding of the upper-level side blocks.

Thus, upon completion of a series of sliding preventive structures, a compression stress is generated in the vertically continued both front constraining layers and both rear constraining-layer forming materials formed in the structure of upper and lower boundaries, and thereby, a compression intensity provided in the constraining-layer forming material, which serves as a reaction force, is propagated to the sliding resistive element. In this way, it becomes possible to utilize the strongest compression intensity of all the intensities provided in the constraining-layer forming material, and thus, a sliding safety factor (Fs) is dramatically improved. As a result, the sliding resistive element (for placing the upper and lower boundary surfaces) can be made small in size, and at the same time, the present invention can be used without worries even in crusher run, etc., of which the internal frictional angle is small, and thus, the economic efficiency is also improved.

(10) In the present invention according to the tenth aspect of the invention, left and right widths of the upper portion of the sliding resistive element are formed to be equal to or narrower than left and right widths of the lower portion of the sliding resistive element.

In this way, the upper portion of the sliding resistive element can be formed to have left and right widths which can be placed between the link bodies of the block, or those across which the left and right side constraining layers can be formed, for example.

Therefore, as described above, between the left and right cross-sectional surfaces of the sliding resistive element and the linking body of the block, the left and right spaces are formed, and the constraining-layer forming material is filled in the both spaces, thereby enabling the formation of the left and right side constraining layers. In this state, against an external force (earthquake, etc.) from left and right directions, the left and right side constraining layers exert a reaction force in left and right directions via the sliding resistive element, thereby preventing the sliding in left and right directions of the block.

Moreover, by the reaction force (passive) exerted by the front, back, left, and right constraining-layer forming materials via the sliding resistive element on the sliding resistive element, the sliding of the block of the upper and lower boundaries at each level in front, back, left and right directions is prevented. Thereby, the sliding resistance in a two-dimensional (plan surface to 360 degrees) direction can be reinforced.

The lower portion of the sliding resistive element can be formed to have left and right widths on which the left and right side link bodies of the block can be mounted, or left and right widths wider than those of the upper portion so that the largest possible passive earth pressure can be exerted.

(11) In the present invention according to the eleventh aspect of the invention, the sliding resistive elements are linked in intervals in front and back directions, and at the same time, the upper portion of at least one of them is formed to upwardly lengthen, and in a space formed between the opposing sliding resistive elements, the grain-sized material or the constraining-layer forming material is filled to form the grain-sized material layer or the constraining layer.

In this way, in the space formed between the opposing sliding resistive elements, the grain-sized material or the constraining-layer forming material is filled to form the grain-sized material layer or the constraining layer. Thus, the passive earth pressure as a reaction force can be more effectively exerted on the grain-sized material.

Specifically, when the active earth pressure is acted, a constraining pressure is generated in the grain-sized material between the opposing (front and back) sliding resistive elements, and the generation and its development of a passive collapse slip surface of the grain-sized forming material is surpressed by the constraining pressure, thereby increasing the shear resistance of the grain-sized material and the passive earth pressure.

Moreover, when a plurality of these sliding resistive elements are embedded within the grain-sized material layer in a linking state, there is formed the grain-sized material layer (foundation unit) having a sliding preventive function of exerting the passive earth pressure, and at the same time, having a ground support function as the foundation block responsible for the ground support force.

Therefore, when the sliding resistive element (that also serves as the foundation block) in which the sliding resistive element and the foundation block are integrally formed is used, and the sliding resistive element (that also serves as the foundation block) is internally and externally filled with the grain-sized material to form the grain-sized material layer, it becomes possible to form a grain-sized material layer that exerts a more effective passive earth pressure and that is responsible for the ground supporting force.

(12) In the present invention according to a twelfth aspect of the invention, the sliding resistive element placed at the position of upper and lower boundary surfaces of the block is linked with the distal end of a ribbon-shaped anchorage, and the leading end of the anchorage is lengthened substantially horizontally in the ground formed behind the retaining wall unit. In this way, the anchorage is embedded in the ground.

In the conventional strengthened earth wall construction, the retaining wall block forming the retaining wall unit is directly linked with the anchorage, and the anchorage is placed to be substantially horizontally lengthened in the ground formed behind the retaining wall unit. Thus, in theory, when the block slides slightly forwardly by the active earth pressure, simultaneously of the sliding of the block, the tension stress is generated in the anchorage, and by the tension stress released from the anchorage, the shearing resistance of the ground material is reinforced, thereby securing the stability of the ground material formed behind the retaining wall unit. The conventional construction is so structured that by the stability of the ground (material), the sliding or falling off the block is prevented. However, when the block is moved more than estimated due to a failure in a building construction, etc., there is a possibility that the safety of the entire retaining wall is deteriorated.

In this regard, in the present invention, the anchorage is not directly linked to the block but the anchorage is linked to the sliding resistive element installed at the positions of upper and lower boundary surfaces of the block. Therefore, in theory, along with a slight movement of the sliding resistive element by the active earth pressure, the tension stress occurs in the anchorage itself linked to the sliding resistive element, and the shear resistance of the ground material is reinforced. On the other hand, the block itself is capable of surely preventing the block from sliding or falling off due to the reaction force (passive) produced, via the sliding resistive element, by the forming material of the both front constraining layers of the upper and lower boundaries at each level. In this way, the effective reaction force is exerted via the sliding resistive element, thereby organically integrating the sliding preventive effect of preventing the sliding of the block, and a ground strengthening effect for strengthening the ground material by linking the anchorage to the sliding resistive element. As a result, the prevent invention can provide a strengthened earth retaining wall construction method using a more steady anchorage.

BRIEF DESCRIPTION OF THE DRAWINGS

FIGS. 5(1) to 5(10) are explanatory diagrams of a building construction of the retaining wall.

FIGS. 6(5') to 6(7') are explanatory diagrams of a building construction of a foundation-unit main body as first alternate embodiment.

DETAILED DESCRIPTION OF THE INVENTION

Hereinafter, embodiments according to the present invention will be described with reference to drawings.

[Retaining Wall as First Embodiment]

Figure 1:
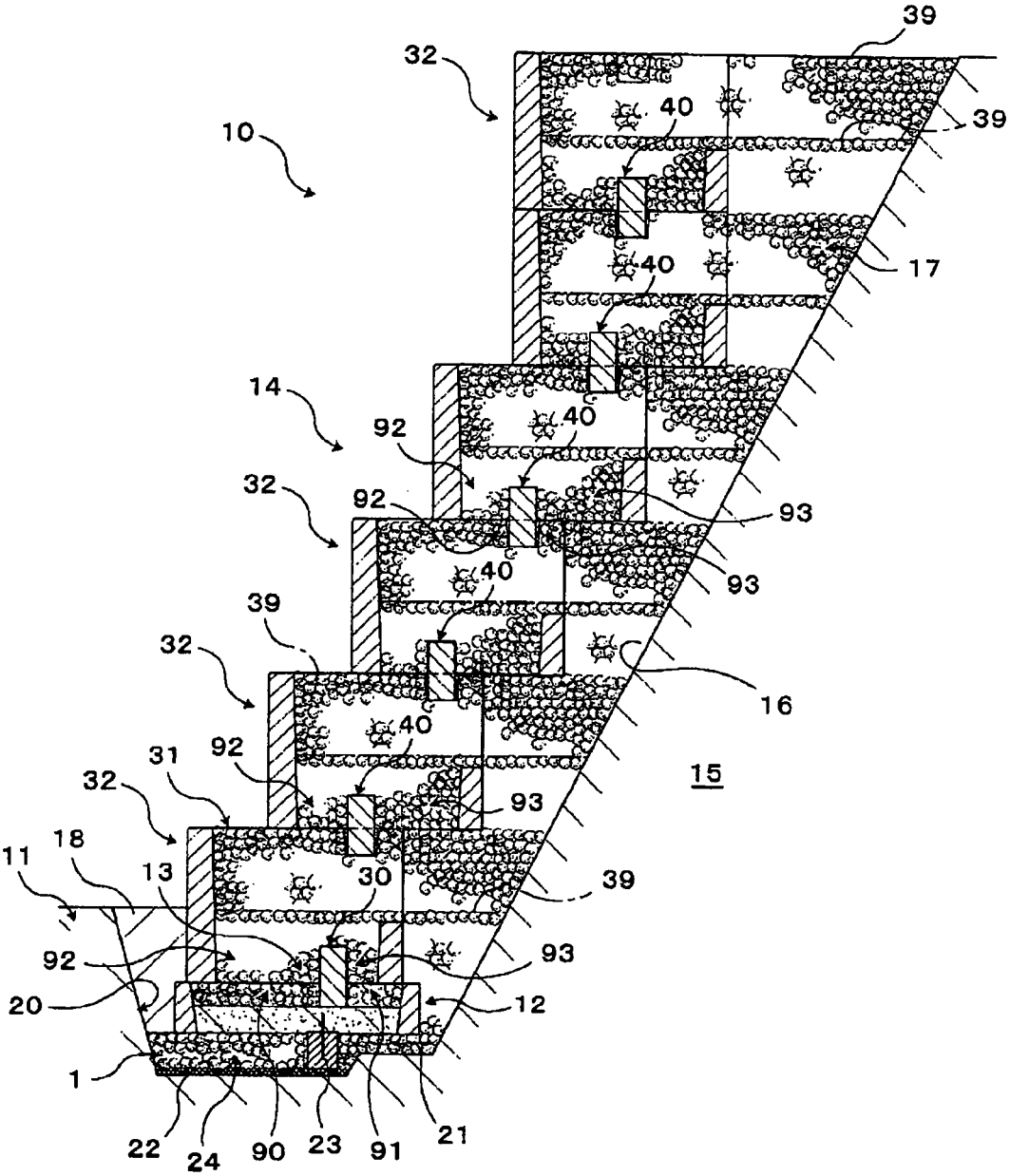
FIG. 1 is an explanatory diagram of a cross-sectional side surface of a retaining wall as a first embodiment according to the present invention.

Reference numeral 10 shown in FIG. 1 is a horizontally stacked retaining wall as a first embodiment. The retaining wall 10 is so configured that a foundation unit 12 is disposed in a foundation ground 11, and via a boundary 13, a retaining wall unit 14 is installed fixedly on the foundation unit 12.

In the present invention, the foundation unit 12, the boundary 13, and the retaining wall unit 14 are each arranged with sliding resistive elements (a foundation unit-use sliding resistive element 23, a boundary-use sliding resistive element 30, and a retaining wall unit-use slide preventing body 40, described later) so as to secure a good sliding preventive function in each of the unit 12, 13, and 14.

The good sliding preventive function of the foundation unit 12 is thus secured. Therefore, a good sliding preventive function of the boundary 13 formed on the foundation unit 12 is further secured and a good sliding preventive function of the retaining wall unit 14 formed on the boundary 13 is still further secured. In this way, the sliding preventive functions in each of the units 12, 13, and 14 are interconnected in a series to exhibit the effect, and a so-called synergy effect is produced.

In FIG. 1, reference numeral 15 denotes a bedrock, 16 denotes a cut plane as a slope, 17 denotes a backfill material such as cobble, and 18 denotes a backfill.

Subsequently, [structure of the foundation unit 12] configured to secure a good sliding preventive function of the foundation unit 12 in the foundation ground 11, [structure of the boundary 13] formed between the foundation unit 12 and the retaining wall unit 14, and [structure of the retaining wall unit 14] will be described with sequential reference to the drawings.

[The Structure of the Foundation Unit 12]

Figure 2:
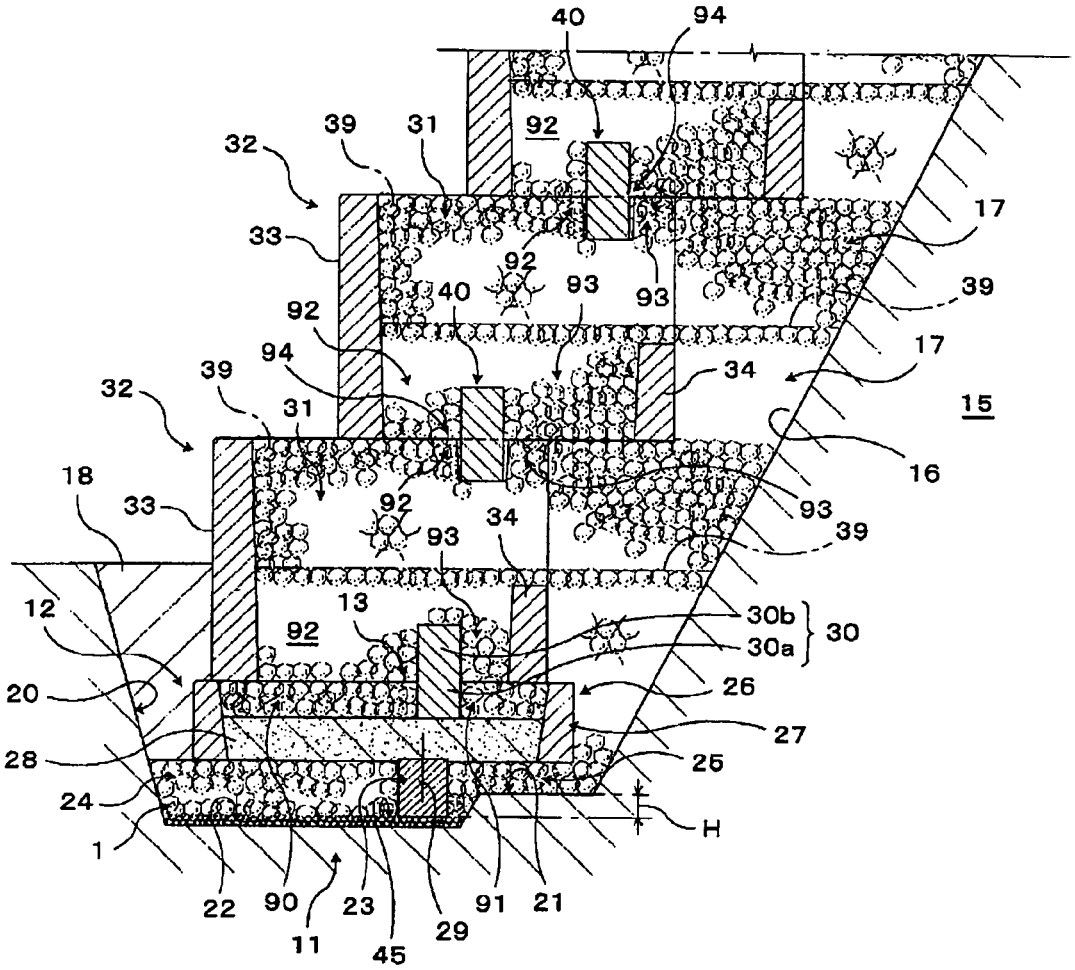
FIG. 2 is an explanatory diagram of an enlarged cross-sectional side surface of a lower half portion of the retaining wall.

As shown in FIG. 1, FIG. 2, and FIG. 5, when the foundation ground 11 is formed with a trench 20—as a concave unit—lengthening in a retaining-wall elongating direction, the foundation unit 12 can be disposed within the trench 20, and at the back on the bottom of the trench 20, there is formed a stepped unit 21 that is a stepped ridge lengthening in the retaining-wall elongating direction (see FIG. 5(1)).

At the front on the bottom of the trench 20, i.e., at the bottom positioned forward of the stepped unit 21 at the bottom of the trench 20, a bottom support material is laid down and a bottom layer 22 is formed through rolling compaction (see FIG. 5(2)). Herein, as the bottom support material, a grain-sized material (for example, a crushed stone) of which the internal frictional angle is equal to or larger than that of a ground material molding the foundation ground 11 is used.

On the bottom layer 22, a plate-like foundation unit-use slide preventing body 23, having a quadrangled vertically long end surface, lengthening in the retaining-wall elongating direction is placed to be positioned immediately forward of the stepped unit 21 (see FIG. 5(3)).

In this way, the foundation unit-use sliding resistive element 23 is placed on the bottom layer 22 formed by laying down the bottom support material such as a crushed stone or grain-sized material, and thus, when the layer thickness of the bottom layer 22 is adjusted, a level adjustment (positional adjustment in up and down directions) of the foundation unit-use sliding resistive element 23 can be easily performed.

On the bottom layer 22, a front grain-sized material layer 24 prepared by filling and rolling-compacting a grain-sized material is formed in a space within the trench 20 formed forward of the foundation unit-use slide preventing body 23 whilst a rear grain-sized material layer 25 prepared by filling and rolling-compacting a grain-sized material is formed in a space within the trench 20 formed backward of the foundation unit-use sliding resistive element 23 and on the stepped unit 21 (see FIG. 5(4)). Herein, as the grain-sized material forming the front and rear grain-sized material layers 24 and 25, a grain-sized material of which the internal frictional angle is equal to or larger than the ground material molding the foundation ground 11 (for example, a gravel with a sand, a crushed stone, a cobble, and concrete fragmented pieces) is used.

In this way, within the trench 20, a foundation-unit forming layer 1 made of the bottom layer 22, the foundation unit-use sliding resistive element 23, and the front and rear grain-sized material layers 24 and 25 is formed (see FIG. 2 and FIG. 5(4)).

Therefore, in such a foundation-unit forming layer 1, a virtual shear surface 45 that acts as a resistant surface during sliding is formed between the front and rear grain-sized material layers 24 and 25 and the bottom layer 22 that is a position of the lower end surface of the foundation unit-use sliding resistive element 23, and thus, even when the foundation ground 11 that is a viscous soil having a small internal frictional angle is used, the small internal frictional angle that is a weak point of the viscous soil can be reinforced and compensated by the bottom support material such as a crushed stone, thereby increasing the shear resistance of the virtual shear surface 45 during sliding. Thus, the grain-sized material can be caused to exert the shearing force and the passive earth pressure in accordance with the internal frictional angle provided in the grain-sized material, thereby increasing the sliding preventive function achieved by the foundation unit-use sliding resistive element 23.

In particularly, when the cobble is used as the grain-sized material, for example, the cobble has an internal frictional angle larger—and a passive collapse angle smaller—than that of a clay or a sandy soil, and thus, the cobble exerts a shearing force larger than that of the clay or the sandy soil so as to exert a passive earth pressure in accordance with the internal frictional angle of the cobble.

In the clayground, a drainage is very poor, and thus, under a non-drainage condition, an effective stress is further decreased and the shear resistance or passive earth pressure is further reduced. However, the cobble that is the grain-sized material and the crushed stone that is the bottom support material excel in drainage, and thus, in this regard also, it is possible to expect a stable shearing force and passive earth pressure that match the internal frictional angle of the cobble.

The stepped unit 21 formed behind the foundation unit-use sliding resistive element 23 is continued to the bedrock 15, and thus, by as much as a height H (see FIG. 2) that is from the virtual shear surface 45 to the upper surface of the stepped unit 21, an earth pressure acting from the bedrock, 15 to the retaining wall 10 can be mitigated. Therefore, the safety of the retaining wall 10 can be increased.

On the foundation-unit forming layer 1 thus configured, a foundation-unit main body 26 is arranged, and at the same time, the foundation-unit main body 26 is integrated with the foundation unit-use sliding resistive element 23 to form the foundation unit 12 (see FIG. 5(5)).

The foundation-unit main body 26 mounts a foundation-unit-main-body forming piece 27, as a quadrangule frame-shaped block, opening in up and down directions, on the front and rear constraining layers 24 and 25, and a solidification material is injected within the foundation-unit-main-body forming piece 27 to a height substantially half that of the foundation-unit-main-body forming piece 27 for a solidifying purpose, thereby integrally forming a flat plate-like foundation-unit-formation solidifying piece 28 (see FIG. 5(6)).

Figure 3:
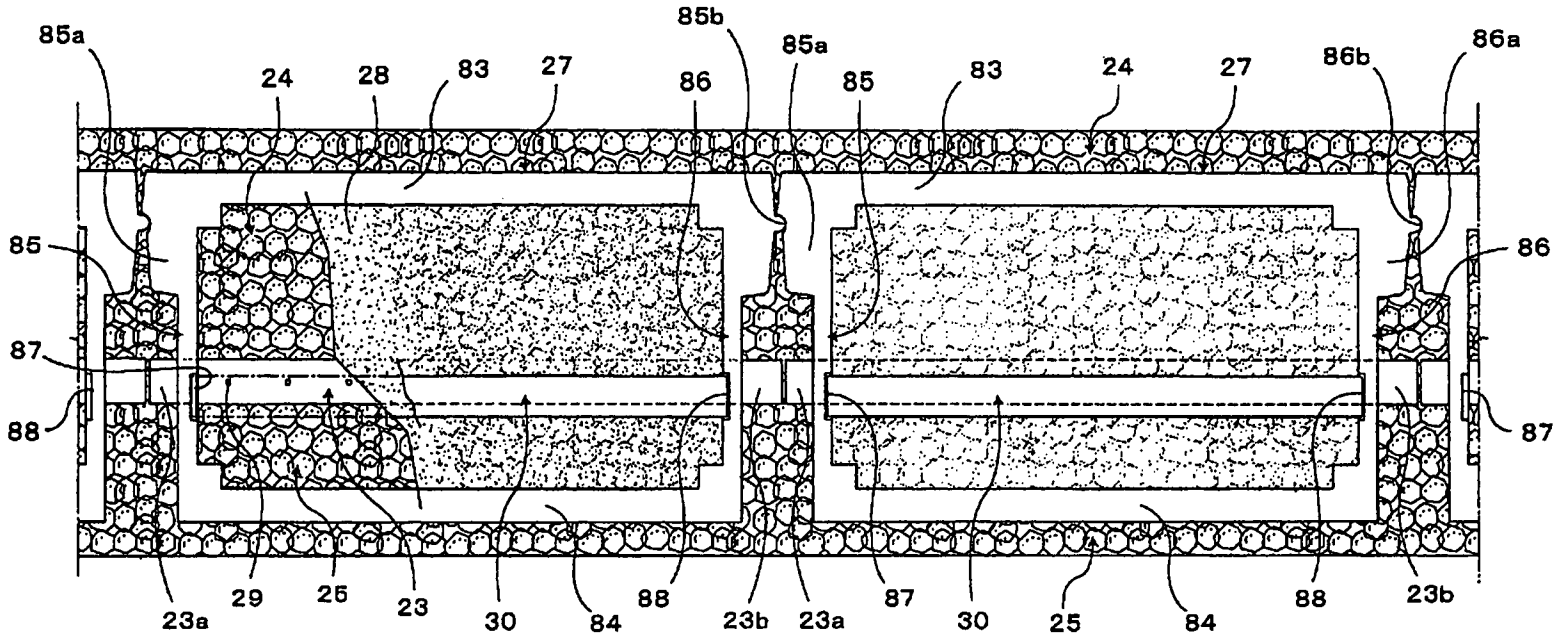
FIG. 3 is an explanatory diagram of a partially cutway plan surface of a foundation unit of the retaining wall.

Herein, the foundation-unit-main-body forming piece 27 as a block, as shown in FIG. 3, is formed in the shape of a laterally-long quadrangle frame, having upper and lower surface openings, and is formed by: front and back walls 83 and 84; and left and right side walls 85 and 86 as link bodies for linking the both front and back walls 83 and 84.

As shown in FIG. 3, at the front of the left and right side walls 85 and 86, left and right side connecting protrusions 85*a* and 86*a* are formed which lengthen in up and down directions across its upper end to the lower end, and the left side connecting protrusion 85*a* is formed with a fitting concave unit 85*b* lengthening in up and down directions whilst the right side connecting protrusion 86*a* is formed with a fitting convex unit 86*b* lengthening in up and down directions, whereby the fitting convex unit 86*b* of the left-side retaining wall block 32 and the fitting concave unit 85*b* of the right-side retaining wall block 82, adjacent in left and right directions, are fitted so as to connect the left and right directions.

Between the upper portions of the left and right side walls 85 and 86, a boundary-use sliding resistive element 30 is laterally placed. That is, as shown in FIG. 3, on the inner side surfaces of the left and right side walls 85 and 86, fitting-use concave units 87 and 88, positioned at the upper portion and the back portion, are formed in a state to oppose in left and right directions. The respective fitting-use concave units 87 and 88 form the inner side surfaces of the left and right side walls 85 and 86 in a reverse trapezoidal concave shape of which the upper and inner sides open.

Across the left and right side walls 85 and 86, the boundary-use slide preventing body 30 described later is disposed laterally via the fitting-use concave units 87 and 88. Herein, front and back widths of the fitting-use concave units 87 and 88 are formed to be slightly wider than the front and back widths of the boundary-use sliding resistive element 30 so as to permit play before and after the boundary-use sliding resistive element 30.

The foundation-unit-formation solidifying piece 28 is formed integrally, through solidification, with the upper surfaces of the front and rear constraining layers 24 and 25 and the upper surface of the foundation unit-use sliding resistive element 23, and at the same time, the upper surface thereof is formed to be a substantially horizontal surface. Reference numeral 29 is an anchor bar arranged to be upwardly salient from the foundation unit-use sliding resistive element 23 (see FIG. 5(6)).

Herein, the left and right widths of the foundation unit-use sliding resistive element 23 are formed to be wider than those of the foundation-unit-main-body forming piece 27, as shown in FIG. 3, and left and right side ends 23*a* and 23*b* of the foundation unit-use sliding resistive element 23 are salient outwardly of the left and right side walls 85 and 86 of the foundation-unit-main-body forming piece 27. The solidification material can be selected from concrete, mortar, etc.

In this way, by using the foundation-unit-main-body forming piece 27 mounted on the front and rear grain-sized material layers 24 and 25 and the foundation-unit-formation solidifying piece 28 integrally formed by solidifying the solidification material within the upper and lower surface openings of the foundation-unit-main-body forming piece 27, the foundation-unit main body 26 is formed. At the same time, the foundation-unit-formation solidifying piece 28 is integrally solidified with the upper surfaces of the front and rear grain-sized material layers 24 and 25 and the upper surface of the foundation unit-use sliding resistive element 23, and thus, the foundation unit 12 can be quickly, easily, and firmly constructed.

At this time, a precast concrete block is adopted for the foundation-unit-main-body forming piece 27, and the foundation-unit-formation solidifying piece 28 is formed by solidifying a cast in-situ concrete. Thus, the foundation unit can be constructed with ease.

Note that in the present embodiment, the flat plate-like foundation-unit-formation solidifying piece 28 is integrally formed over the entire surface within the foundation-unit-main-body forming piece 27. However, in the foundation-unit-formation solidifying piece 28, up-and-down direction communicating unit (not shown) may be formed for communicating the interior of the retaining wall block 32 described later and the front and rear grain-sized material layers 24 and 25.

In this way, when the retaining wall block 32 is used as a vegetation block, plants vegetated in the vegetation block can lengthen its root to the foundation ground 11 through the up-and-down direction communicating unit.

[The Structure of the Boundary Unit 13]

As shown in FIG. 1 to FIG. 3, across the foundation-unit-main-body forming piece 27, the boundary-use sliding resistive element 30 is disposed laterally. The boundary-use sliding resistive element 30 is formed in a plate shape, having a quadrangled vertically long end surface, lengthening in a retaining-wall elongating direction, and at the same time, is formed by: a constrained unit 30*a* that is laterally disposed in a beam shape so that left and right side ends are fitted to the fitting-use concave units 87 and 88 formed on the left and right side walls 85 and 86 of the foundation-unit-main-body forming piece 27; and a constraining unit 30*b* formed to elongate upwardly saliently from the upper-end edge of the constrained unit 30*a*.

In this way, by fitting the left and right side ends of the boundary-use sliding resistive element 30 to the fitting-use concave units 87 and 88 formed on the left and right side walls 85 and 86 of the foundation-unit-main-body forming piece 27 in a laterally dispoded manner in a beam shape, the boundary-use sliding resistive element 30 can be placed (positioned), with ease, in a stable state on the foundation-unit-formation solidifying piece 28 within the foundation-unit-main-body forming piece 27. The boundary-use slide preventing body 30 is linked to the foundation-unit-main-body forming piece 27 substantially parallel to the back wall 84 at a position slightly backwardly of a center portion of the front and back widths of the foundation-unit-formation solidifying piece 28 (see FIG. 5(7)).

Then, within the foundation-unit-main-body forming piece 27, in a space on the foundation-unit-formation solidifying piece 28 formed before and after the boundary-use sliding resistive element 30, an internally filled material 31 which is a constraining-layer forming material is filled, and at the same time, the front and rear constraining layers 90 and 91 are formed by rolling compaction so as to be flush with the upper end surface of the foundation-unit-main-body forming piece 27 (see FIG. 5(7)).

As a result, the constrained unit 30*a* of the boundary-use slide preventing body 30 disposed laterally across the left and right side walls 85 and 86 of the foundation-unit-main-body forming piece 27 is supported also from front and back directions as a result of mutual interlocking of the internally filled material 31 respectively forming the front and rear constraining layers 90 and 91 whilst the constraining unit 30*b* of the boundary-use sliding resistive element 30 is in a state of being upwardly salient from the internally filled material 31. Herein, the internally filled material 31 can be selected from block objects such as a crushed stone, a cobble, concrete fragmented pieces, or solidification materials such as a concrete and a mortar.

The retaining wall unit 14 described later is formed by stacking a plurality of levels of retaining wall blocks 32 as blocks one above another, as shown in FIG. 1.

Figure 4A:
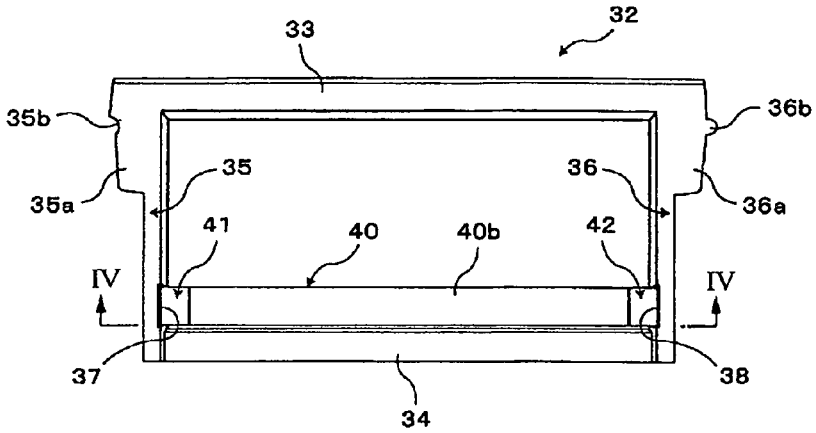
FIGS. 4(*a*), 4(*b*) and 4(*c*) are explanatory diagrams of the retaining block (FIG. 4(*a*) being a plan view, FIG. 4(*b*) being a cross-sectional view taken along a line IV-IV of FIG. 4(*a*), and FIG. 4(*c*) being a cross-sectional side surface view).
Figure 4B:
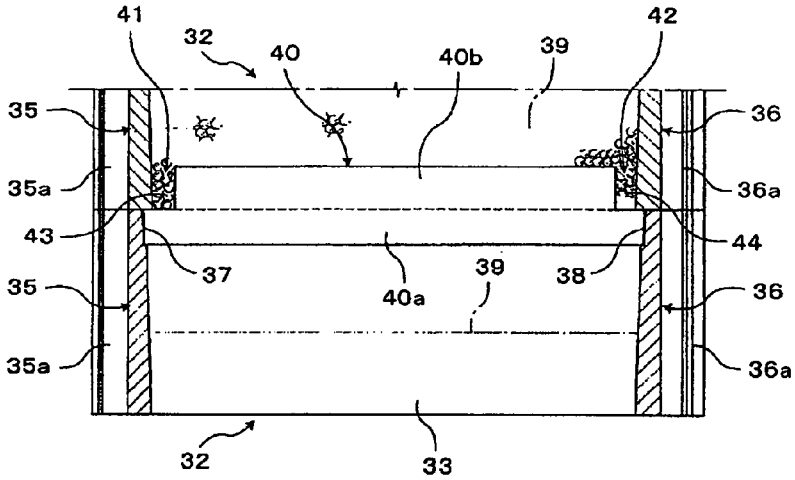
Figure 4C:
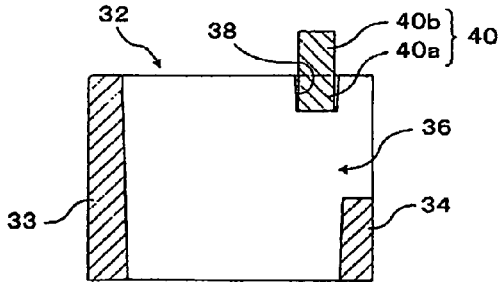
Figure 7A:
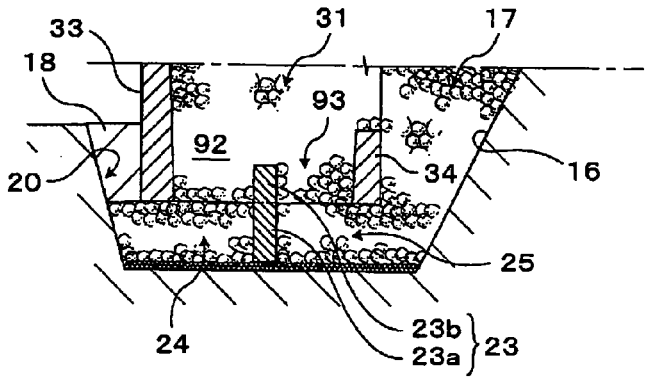
FIGS. 7(*a*) to 7(*d*) are explanatory diagrams of the foundation unit as a second alternate embodiment (FIG. 7(*a*) being a cross-sectional side surface view, FIG. 7(*b*) being a partially cutaway plan view, FIG. 7(*c*) being a cross-sectional rear surface view, and FIG. 7(*d*) being a dynamic explanatory view).
Figure 7B:
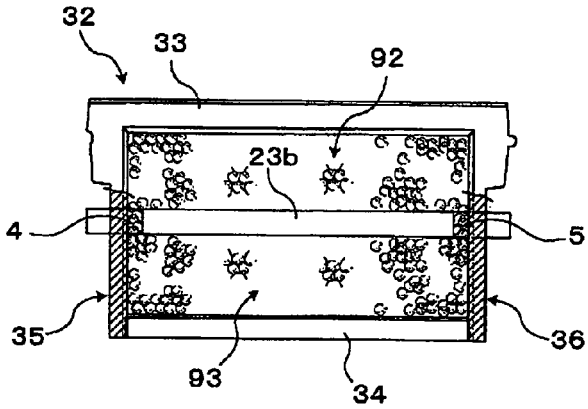
Figure 7C:
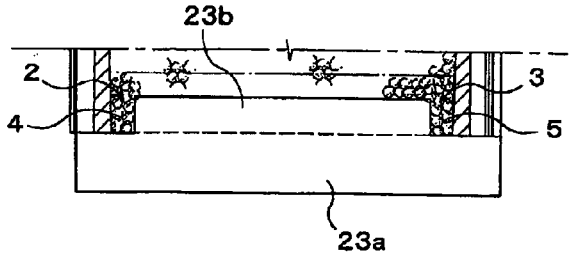
Figure 7D:
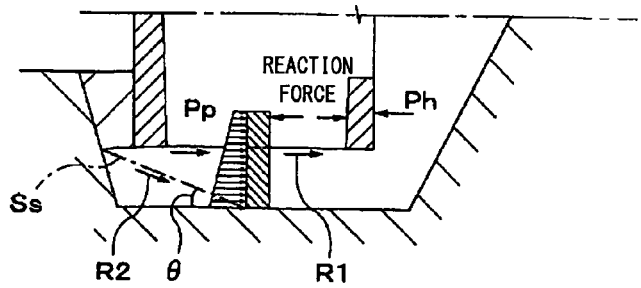
Figure 8A:
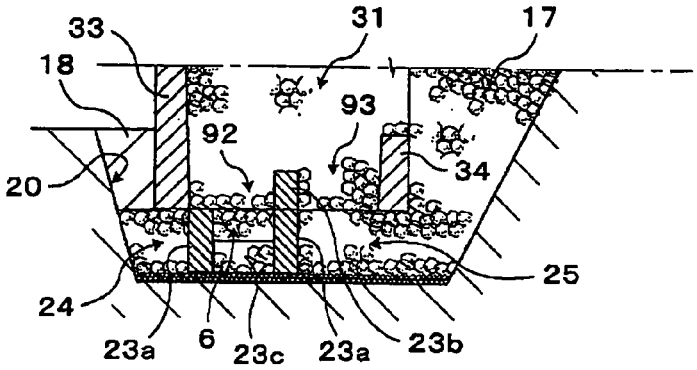
FIGS. 8(*a*) to 8(*d*) are explanatory diagrams of the foundation unit as a third alternate embodiment (FIG. 8(*a*) being a cross-sectional side surface view, FIG. 8(*b*) being a partially cutaway plan view, FIG. 8(*c*) being a cross-sectional rear surface view, and FIG. 8(*d*) being a dynamic explanatory view).
Figure 8B:
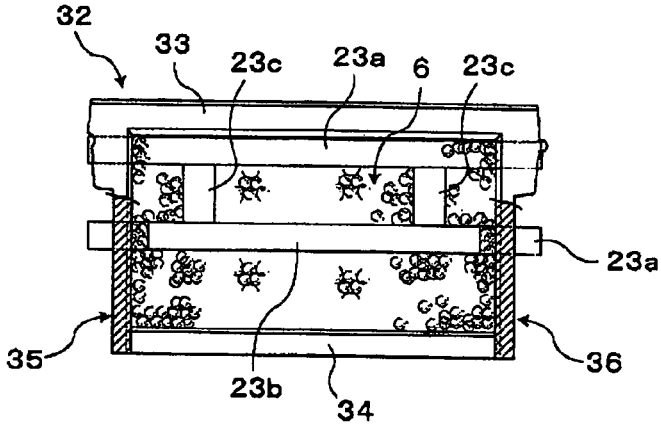
Figure 8C:
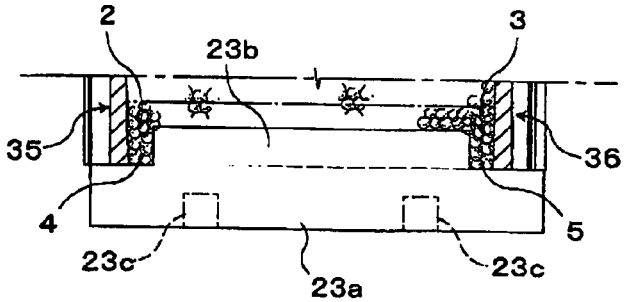
Figure 8D:
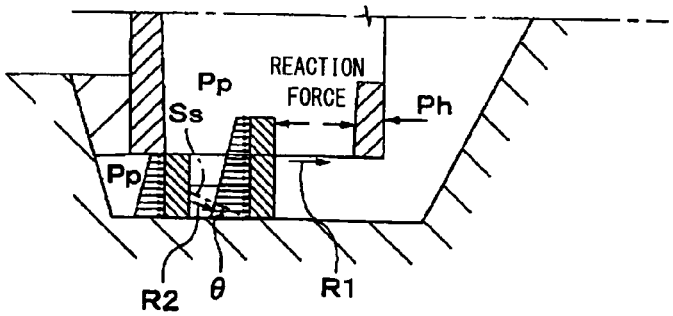

As shown in FIG. 4, each of the retaining wall blocks 32 is formed by the front and back walls 33 and 34 and the left and right side walls 35 and 36, as link bodies, for linking the both front and back walls 33 and 34, in a quadrangled tubular shape opening in up and down directions. The back wall 34 is formed so low that its height is substantially half that of the front wall 33. Note that the height of the back wall 34 suffices to be substantially equal to or less than half that of the front wall 33, and the present embodiment is not limiting.

The retaining wall block 32 forming the lowest level in such a retaining wall unit 14 is mounted on the front and rear constraining layers 90 and 91 formed through filling and rolling compaction of the internally filled material 31 within the foundation-unit-main-body forming piece 27. Between the front wall 33 and the back wall 34 of the retaining wall block 32, the constraining unit 30*b* of the boundary-use sliding resistive element 30 is placed. The internally filled material 31 is filled in a space formed between the front wall 33 and the constraining unit 30*b*. In this way, the front constraining layer 92 for constraining backward sliding of the retaining wall block 32 is formed at the same time, the internally filled material 31 is filled between the constraining unit 30*b* and the back wall 34 of the retaining wall block 32, thereby forming a rear constraining layer 93 for constraining forward sliding of the retaining wall block 32.

Moreover, the internally filled material 31 is filled and rolling-compacted to a rolling-compaction line 39 slightly above the upper end of the back wall 34, and thereby, the boundary 13 is formed between the foundation unit 12 and the lowest-level retaining wall block 32 (see FIG. 5(8)).

Herein, the rolling-compaction line 39 is a working line to roll compact the internally filled material 31 filled within the retaining wall block 32 and a backfill material 17 filled behind the retaining wall block 32, as shown in FIG. 2 and FIGS. 5(8) and 5(9). In the present embodiment, the rolling-compaction line 39 is set to a position substantially half in height the retaining wall block 32 (position higher than the back wall) and to a position at the height of the upper end surface of the retaining wall block 32.

In this way, the boundary 13 is formed between the foundation unit 12 and the lowest-level retaining wall block 32, and thus, the internally filled materials 31 of the front and rear constraining layers 92 and 93 formed before and after the constraining unit 30*b* of the boundary-use sliding resistive element 30 are mutually interlock (unless the foundation unit 12 slides and the boundary-use sliding resistive element 30 is destructed), resulting in a structure for constraining sliding of the retaining wall block 32 in both front and back directions. The technology provided in the present invention in which the internally filled materials 31 of the front and rear constraining layers 90 and 91 formed by filling the internally filled material 31 via the boundary-use sliding resistive element 30 is caused to exert a reaction force against the sliding is a structure for a dry-masonry retaining wall totally different from the conventional dry-masonry retaining wall that resists the sliding by the shearing force of the internally filled material 31, etc., on the upper and lower-level retaining wall block boundary surfaces.

Therefore, unlike the conventional dry-masonry retaining wall dominated by a wall body weight and a friction force ($\mu$=tam $\phi$) of the internally filled material 31 at the boundary 13, the present invention can achieve a highly safe structure for a dry-masonry retaining wall capable of steadily constraining the sliding in front and back directions of the lowest-level retaining wall block 32 unless the foundation unit 12 slides or the boundary-use slide preventing body 30 is destructed.

Moreover, even when the constraining unit 30*b* is placed in a state of contacting the back wall 34 without filling the internally filled material 31 in between the constraining unit 30*b* and the back wall 34 of the retaining wall block 32, the back wall 34 of the upper-level retaining wall block 32 is engaged with the constraining unit 30*b* from backward to forward, and as a result, a sliding preventive force of the upper-level retaining wall block 32 in a front direction can be increased.

Alternatively, as the internally filled material 31 filled within the foundation-unit-main-body forming piece 27, instead of the block object, a solidification material can be injected for solidification. In this way, the flat plate-like foundation-unit-formation solidifying piece 28 can be formed integrally with the foundation-unit-main-body forming piece 27 and the constrained unit 30*a* of the boundary-use sliding resistive element 30.

[The Structure for the Retaining Wall Unit 14]

As shown in FIGS. 1 and 2, the retaining wall unit 14 is formed by stacking a plurality (six, in the present embodiment) of retaining wall blocks 32 one above another. As shown in FIG. 4, each of the retaining wall blocks 32 is formed by the front and back walls 33 and 34 and the left and right side walls 35 and 36 for linking between the left and right side ends of the both front and back walls 33 and 34, in a quadrangled tubular shape opening in up and down directions. The back wall 34 is formed so low that its height is equal to or less than half that of the front wall 33.

At the front of the left and right side walls 35 and 36, left and right side connecting protrusions 35*a* and 36*a* are formed which lengthen in up and down directions across its upper to lower ends, and the left side connecting protrusion 35*a* is formed with a fitting concave unit 35*b* lengthening in up and down directions whilst the right side connecting protrusion 36*a* is formed with a fitting convex unit 36*b* lengthening in up and down directions, whereby the fitting convex unit 36*b* of the left-side retaining wall block 32 and the fitting concave unit 35*b* of the right-side retaining wall block 32, adjacent in left and right directions, are fitted so as to connect the left and right directions.

Between the upper portions of the left and right side walls 35 and 36, the retaining wall unit-use sliding resistive element 40 is disposed laterally for a purpose of linking, similarly to the foundation-unit-main-body forming piece 27.

That is, as shown in FIG. 4, on the inner surfaces of the left and right side walls 35 and 36, fitting-use concave units 37 and 38, positioned at the upper portion and the back portion, are formed in a state to oppose in left and right directions. The respective fitting-use concave units 37 and 38 are formed in a reverse trapezoidal concave shape of which the upper and inner sides open on the inner surfaces of the left and right side walls 35 and 36.

The retaining wall unit-use sliding resistive element 40 is formed in a plate shape, having a quadrangled vertically long end surface, lengthening in a retaining-wall elongating direction, and at the same time, is formed by: a constrained unit 40*a* of which the lower half portion is disposed laterally in a beam shape so that left and right side ends are fitted to the fitting-use concave units 37 and 38 formed; and a constraining unit 40*b* formed to elongate upwardly saliently from the upper-end edge of the constrained unit 40*a*.

The constraining unit 40*b* forms its left and right widths narrower than those of the constrained unit 40*a*, and forms interference-avoiding spaces 41 and 42 leftward and rightward of the constraining unit 40*b* and above the ends on left and right sides of the constrained unit 40*a*.

That is, the constraining unit 40*b* of the retaining wall unit-use sliding resistive element 40 is formed to have left and right widths capable of being placed between the left and right side walls 35 and 36 of the retaining wall block 32, and moreover, to have left and right widths capable of forming the left/right-sides constraining layers 43 and 44 by filling the internally filled material 31 within each of the interference-avoiding spaces 41 and 42 while securing the interference-avoiding spaces 41 and 42.

In this way, between the left and right side walls 35 and 36 of the retaining wall block 32, the constrained unit 40*a* of the retaining wall unit-use sliding resistive element 40 is laterally disposed via the fitting-use concave units 37 and 38 for a purpose of positioning, and in this state, the internally filled material 31 is filled within the retaining wall block 32 thereby to form the front constraining layer 92 and the rear constraining layer 93, and rolling compaction is so performed that the upper end surface of the retaining wall block 32 and the upper surface of the filled internally filled material 31 are substantially flush.

In such a state, the constrained unit 40*a* of the retaining wall unit-use sliding resistive element 40 is embedded within the filled internally filled material 31, and at the same time, the constraining unit 40*b* is upwardly salient above the upper surface of the filled internally filled material 31, and leftward and rightward of the constraining unit 40*b*, the interference-avoiding spaces 41 and 42 are secured. At this time, the constrained unit 40*a* of the retaining wall unit-use sliding resistive element 40 disposed laterally between the left and right side walls 35 and 36 of the retaining wall block 32 is supported also from the front and back directions as a result of mutual interlocking of the internally filled materials 31 respectively forming the front and rear constraining layers 92 and 93.

In such a state, on the retaining wall block 32, the retaining wall block 32 for an upper level is mounted. At this time, the constraining unit 40*b* of the retaining wall unit-use sliding resistive element 40 disposed laterally between the left and right side walls 35 and 36 of the lower-level retaining wall block 32 is placed substantially parallel to between the front and back walls 33 and 34 of the retaining wall block 32 mounted on the upper level.

Herein, leftward and rightward of the constraining unit 40*b*, the interference-avoiding spaces 41 and 42 are secured. Thus, the upper-level retaining wall block 32 can freely set its mounting attitude in front, back, left, and right directions without allowing the left and right side walls 35 and 36 to be interfered by the constraining unit 40*b*.

Within the retaining wall blocks 32 stacked toward the upper level one above another, when the internally filled material 31 is filled in a space formed between the front wall 33 of the retaining wall blocks 32 and the constraining unit 40*b* of the retaining wall unit-use sliding resistive element 40 arranged in the lower-level retaining wall block 32, the front constraining layer 92 for constraining the backward sliding of the upper-level retaining wall block 32 is formed, and at the same time, when the internally filled material 31 is filled in between the constraining unit 40*b* and the back wall 34 of the upper-level retaining wall blocks 32, the rear constraining layer 93 for constraining the forward sliding of the upper-level retaining wall blocks 32 is formed (see FIG. 5(9)).

Moreover, in a state where the upper-level retaining wall blocks 32 are mounted, when the internally filled material 31 is filled in the interference-avoiding space 41 secured leftward of the constraining unit 40*b*, the left-side constraining layer 43 for constraining rightward sliding of the upper-level retaining wall block 32 is formed, and at the same time, when the internally filled material 31 is filled in the interference-avoiding space 42 secured rightward of the constraining unit 40*b*, the right-side constraining layer 44 for constraining leftward sliding of the upper-level retaining wall block 32 is formed.

Thereafter, the internally filled material 31 and the backfill material 17 are simultaneously filled and rolling-compacted to the rolling-compaction line 39 slightly above the upper end of the back wall 34 (see FIG. 5(9)).

Subsequently, between the left and right side walls 35 and 36 of the retaining wall block 32, the constrained unit 40*a* of the retaining wall unit-use sliding resistive element 40 is disposed laterally via the fitting-use concave units 37 and 38, and in this state, the internally filled material 31 is filled within the retaining wall block 32 and the backfill material 17 is filled therebehind. In this way, rolling compaction is so performed that the upper end surface of the retaining wall block 32 and the upper surfaces of the filled internally filled material 31 and backfill material 17 are substantially flush (see FIG. 5(10)).

Hereinafter, when the above-described procedure is repeated until a required number of levels are constructed, the retaining wall units 14 can be constructed while forming a boundary between retaining wall blocks 94, between the retaining wall blocks 32 and 32 at each upper or lower level.

In this way, when the upper-level retaining wall block 32 is linked to the lower-level retaining wall block 32 by laterally disposing the constrained unit 40*a* of the retaining wall unit-use sliding resistive element 40, if an earth pressure, etc., are acted on the back wall 34 of the upper-level retaining wall block 32 from behind, the acting force is propagated from the back wall 34 of the upper-level retaining wall block 32→the constraining-layer forming material (internally filled material 31) forming the rear constraining layer 93→the retaining wall unit-use sliding resistive element 40→the lower-level retaining wall block 32. Substantially simultaneously of this propagation, the constraining-layer forming material (internally filled material 31) forming the rear constraining layer 93 on the back surface side of the retaining wall unit-use sliding resistive element 40 exerts a reaction force, thereby steadily preventing the forward sliding of the upper-level retaining wall block 32.

Moreover, when the external force, as a sliding force in the event of an earthquake, etc., is acted from forward on the front wall of the upper-level block, the external force is propagated from the front wall 33 of the upper-level retaining wall block 32→the constraining-layer forming material (internally filled material 31) forming the front constraining layer 92→the retaining wall unit-use sliding resistive element 40→the lower-level retaining wall block 32. Substantially simultaneously of this propagation, the constraining-layer forming material (internally filled material 31) forming the front constraining layer 92 on the front surface side of the retaining wall unit-use sliding resistive element 40 exerts a reaction force, thereby steadily preventing the backward sliding of the upper-level retaining wall block 32.

Likewise, when the sliding force in the left (or right) direction is acted on the upper-level retaining wall block 32 in the event of an earthquake, etc., the constraining-layer forming materials (internally filled materials 31) forming the left and right side constraining layers 43 and 44 on the left and right sides of the retaining wall unit-use sliding resistive element 40 are mutually interlocking via the retaining wall unit-use sliding resistive element 40, resulting in exerting a reaction force on the sliding force acted in the left and right directions.

That is, the sliding force is propagated from the left (right) side walls 35 and 36 of the upper-level retaining wall block 32→other constraining-layer forming materials (internally filled materials 31) on the left (right) sides at an upper level→the retaining wall unit-use sliding resistive element 40.

At this time, the constrained unit 40*a* of the retaining wall unit-use sliding resistive element 40 is linked to the lower-level retaining wall block 32, and thus, the constraining-layer forming materials on the left and right sides of the upper-level retaining wall block 32 are mutually interlocked so as to exert a reaction force in the left (right) direction, thereby steadily preventing sliding in the left (right) direction of the upper-level retaining wall block 32.

In this way, the boundary between retaining wall blocks 94 is formed between the retaining wall blocks 32 and 32 at the respective upper and lower levels, and thus, it is possible to prevent the both retaining wall blocks 32 and 32 forming the retaining wall unit 14 from sliding at the boundary between retaining wall blocks 94 in front and back directions and in left and right directions.

That is, the present invention provides a structure in which due to the interaction between the front and rear constraining layers 92 and 93 formed before and after the retaining wall unit-use sliding resistive element 40, the reaction force against the sliding in the front and back directions of the respective retaining wall blocks 32 stacked one above another in the up and down directions is exerted, and at the same time, due to the interaction between the left an right side constraining layers 43 and 44, the reaction force against the sliding in the left and right directions of the respective retaining wall blocks 32 is exerted, which forms a dry-masonry retaining wall totally different from the conventional one in which the sliding force is resisted against the sliding force by the shearing force provided between the internally filled materials 31.

Therefore, similarly to the boundary 13 formed between the foundation unit 12 and the retaining wall unit 14, the boundary between retaining wall blocks 94 formed between the retaining wall blocks 32 and 32 at upper and lower levels can also be so structured to exert the reaction force against the sliding. Thereby, as compared to the conventional retaining wall unit of the dry-masonry retaining wall, it is possible to construct the retaining wall unit 14 more excellent in safety.

In addition, in the respective retaining wall blocks 32, the retaining wall unit 14 is formed in a state where the sliding in the front and back directions and the left and right directions is constrained by the front and rear constraining layers 92 and 93 and the left and right side constraining layers 43 and 44 formed by filling therein the internally filled material 31. Thus, it is possible to constrain the sliding in the front and back directions and the left and right directions of the respective retaining wall blocks 32, and at the same time, it is possible to construct the retaining wall unit 14 easily and steadily.

Further, when the interference-avoiding spaces 2, 3, 41, and 42 are formed, a block-installing deviation width in the retaining-wall elongating direction is permitted, thereby facilitating a curve construction of the retaining wall 10.

Moreover, even when it is so placed that the constraining unit 40*b* is in a state of contacting the back wall 34 without filling the internally filled material 31 in between the constraining unit 40*b* of the retaining wall unit-use sliding resistive element 40 and the back wall 34 of the retaining wall blocks 32 stacked one above another toward an upper level, the back wall 34 of the upper-level retaining wall block 32 is engaged with the containing unit 40*b* from backward to forward, thereby increasing a sliding preventive force provided by the upper-level retaining wall block 32 in a front direction.

The retaining wall 10 as the first embodiment is configured as described above. In the foundation structure, it is possible to cause the foundation unit-use sliding resistive element 23 to surely act the passive earth pressure exerted on the front and rear constraining units 24 and 25, thereby enabling steady prevention of the sliding of the foundation unit 12.

At the boundary 13, the sliding in the front and back, and left and right directions of the lowest-level retaining wall block 32 mounted on the foundation unit 12 can be more steadily prevented by the boundary-use sliding resistive element 30.

Moreover, the sliding in the front and back directions and left and right directions of the retaining wall blocks 32 stacked one above another on the lowest-level retaining wall block 32 can be steadily prevented by the retaining wall unit-use sliding resistive element 40.

In this way, the sliding of each unit from the lower unit to the upper unit of the retaining wall 10 can be steadily prevented (i.e., the foundation unit 12 of the retaining wall 10→the boundary 13→the boundary between retaining wall blocks 94 among the respective retaining wall blocks 32 formed by stacking one above another in the up and down directions so as to form the retaining wall unit 14). Thus, it is possible to integrally prevent the sliding of the retaining wall 10 itself.

At this time, the retaining wall 10 implements integral sliding prevention in the front and back directions, from the foundation unit 12 at the lowest to the retaining wall block 32 at the highest, and is structured to implement the sliding prevention similarly in the left and right directions. Thus, the present invention exhibits the effect, in particular, in the event of an earthquake.

[First Alternate Embodiment of the Foundation Unit 12]

Subsequently, with reference to FIG. 6, a first alternate embodiment of the foundation unit 12 will be described.

That is, a foundation-unit main body 26 of the foundation unit 12 shown in FIG. 6 is formed by directly casting a cast in-situ concrete, etc., as a solidification material, on the front and rear constraining layers 24 and 25 of the foundation-unit forming layer 1.

Its building construction procedure will be described. As shown in FIG. 6(5'), similarly to the preceding first embodiment, the front and rear constraining layers 24 and 25 of the foundation-unit forming layer 1 are formed, a shuttering 50 is placed on the front and rear constraining layers 24 and 25, a support base 51 is mounted on the front and rear constraining layers 24 and 25 within the shuttering 50, and on the support base 51, the boundary-use sliding resistive element 30 is supported.

Subsequently, as shown in FIG. 6(6'), within the shuttering 50, a cast in-situ concrete, etc., are cast, and thereby, the foundation-unit main body 26 is formed by integrating with upper surfaces of the foundation unit-use sliding resistive element 23, the boundary-use sliding resistive element 30, and the front and rear constraining layers 24 and 25.

This is followed by deshuttering, as shown in FIG. 6(7'), and then, the retaining wall block 32 is mounted.

In this way, the foundation-unit main body 26, which is formed by solidifying the cast in-situ concrete, etc., can be constructed quickly, easily, and steadily, even when the foundation-unit main body 26 is large.

[Second Alternate Embodiment of the Foundation Unit 12]

Subsequently, with reference to FIG. 7, a second alternate embodiment of the foundation unit 12 will be described.

In the foundation unit 12 shown in FIG. 7, the foundation unit-use sliding resistive element 23 is formed in a plate-like shape, to have a quadrangled vertically long end surface, lengthening in the retaining-wall elongating direction, and is formed by the constrained unit 23*a* forming a lower half portion, and the constraining unit 23*b* formed to upwardly elongate from the upper-end edge of the constrained unit 23*a*. The constraining unit 23*b* forms its left and right widths narrower than those of the constrained unit 23*a*, and forms the interference-avoiding spaces 2 and 3 leftward and rightward of the constraining unit 23*b* and above the ends on left and right sides of the constrained unit 23*a*.

That is, as shown in FIGS. 7(*a*) to (*c*), the constraining unit 23*b* of the foundation unit-use sliding resistive element 23 is formed to have a left-to-right inner-surface width capable of being placed between the left and right side walls 35 and 36 of the retaining wall block 32 as a block (or between the left and right side walls 85 and 86 of the foundation-unit-main-body forming piece 27), and further, to have a left-to-right inner-surface width capable of forming the left and right side constraining layers 4 and 5 by filling the internally filled material 31 as the constraining-layer forming material within each interference-avoiding space 2 while securing the interference-avoiding spaces 2 and 3, whilst the constrained unit 23*a* of the foundation unit-use sliding resistive element 23 is formed to have a left-to-right width on which the left and right side walls 35 and 36 of the retaining wall block 32 (or the left and right side walls 85 and 86 of the foundation-unit-main-body forming piece 27) can be directly mounted, and further, to have left and right widths larger than the preceding width so that a passive earth pressure as large as possible can be exerted.

Such a foundation unit-use sliding resistive element 23 is mounted on the bottom layer 22 and the constraining-layer forming material is filled on the front surface side of the constrained unit 23*a* of the foundation unit-use sliding resistive element 23, thereby forming the front grain-sized material layer 24. At the same time, the constraining-layer forming material is filled on the back surface side of the constrained unit 23*a*, thereby forming the rear grain-sized material layer 25. In this way, the foundation-unit forming layer 1 is so configured that the sliding of the foundation unit-use sliding resistive element 23 in the front and back directions is constrained via the front and rear constraining layers 24 and 25.

On the foundation-unit forming layer 1, the retaining wall block 32 (or the foundation-unit-main-body forming piece 27) is mounted, and between the front and back walls 33 and 34 of the retaining wall block 32, the constraining unit 23*b* of the foundation unit-use sliding resistive element 23 upwardly salient from the foundation-unit forming layer 1 is placed, and the constraining-layer forming material is filled in a space formed between the front wall 33 and the constraining unit 23*b* of the retaining wall block 32 thereby to form the front constraining layer 92 (or the front constraining layer 90), and at the same time, the constraining-layer forming material is filled in a space formed between the constraining unit 23*b* and the back wall 34 of the retaining wall block 32 thereby to form the rear constraining layer 93 (or the rear constraining layer 91).

Therefore, as shown in FIG. 7(*d*), when a sliding force occurs due to an active earth pressure Ph, etc., in the retaining wall block 32 mounted on the foundation-unit forming layer 1, the sliding force is acted on the rear constraining layer 93 (or the rear constraining layer 91) formed between the back wall 34 of the retaining wall block 32 and the constraining unit 23*b* of the foundation unit-use sliding resistive element 23, and when the acting force is propagated via the rear constraining layer 93 (or the rear constraining layer 91) to the foundation unit-use sliding resistive element 23, substantially simultaneously of this propagation, the constraining-layer forming material on the front surface side of the foundation unit-use slide preventing body 23 exerts the passive earth pressure Pp on the foundation unit-use sliding resistive element 23, thereby enabling intensification of a resistance relative to the sliding of the retaining wall block 32 mounted on the foundation-unit forming layer 1. Reference letter Ss shown in FIG. 7(*d*) denotes a passive collapse slip surface of the constraining-layer forming material, θ denotes a passive collapse angle, $\theta=45°-\phi/2$, ϕ denotes an internal frictional angle of the constraining-layer forming material, and R1 and R2 denote a shear resistance.

When it is assumed that as a sliding force caused due to an earthquake, etc., an external force is acted from forward on the front wall 33 of the retaining wall block 32 mounted on the foundation-unit forming layer 1, the external force is propagated from the front wall 33 of the retaining wall block 32→the constraining-layer forming material forming the front constraining layer 92 (or the front constraining layer 90)→the foundation unit-use slide preventing body 23, and when the foundation unit-use sliding resistive element 23 is moved backwardly slightly, the external force is propagated from the foundation unit-use sliding resistive element 23 to the constraining-layer forming material on the back surface side. Substantially simultaneously of this propagation, the constraining-layer forming material on the back surface side of the foundation unit-use sliding resistive element 23 exerts the passive earth pressure Pp, as a reaction force, on the foundation unit-use sliding resistive element 23, thereby steadily preventing the sliding of the retaining wall block 32 in the back direction.

In this way, by filling the constraining-layer forming material via the constraining unit 23*b* of the foundation unit-use sliding resistive element 23 within the retaining wall block 32, the front constraining layer 92 (or the front constraining layer 90) and the rear constraining layer 93 (or the rear constraining layer 91) are respectively formed. The constraining-layer forming materials of the both front and rear constraining layers 92 and 93 (or the both front and rear constraining layers 90 and 91) are mutually interlocked, thereby steadily preventing the sliding of the retaining wall block 32 in the front and back directions.

Moreover, when the sliding force in the left (or right) direction is acted on the retaining wall block 32 due to an earthquake, etc., the constraining-layer forming materials forming the left and right side constraining layers 4 and 5 of the foundation unit-use sliding resistive element 23 are mutually interlocked via the foundation unit-use sliding resistive element 23, thereby exerting a reaction force against the sliding force acted in the left and right directions.

That is, the sliding force, as the acting force, is propagated to the left (right) side walls 35 and 36 of the retaining wall block 32 (or the left (right) side walls 85 and 86 of the foundation-unit-main-body forming piece 27))→the constraining-layer forming materials of the left and right side constraining layers 4 and 5→the foundation unit-use sliding resistive element 23.

[Third Alternate Embodiment of the Foundation Unit 12]

Subsequently, with reference to FIG. 8, a third alternate embodiment of the foundation unit 12 will be described.

Figure 9:
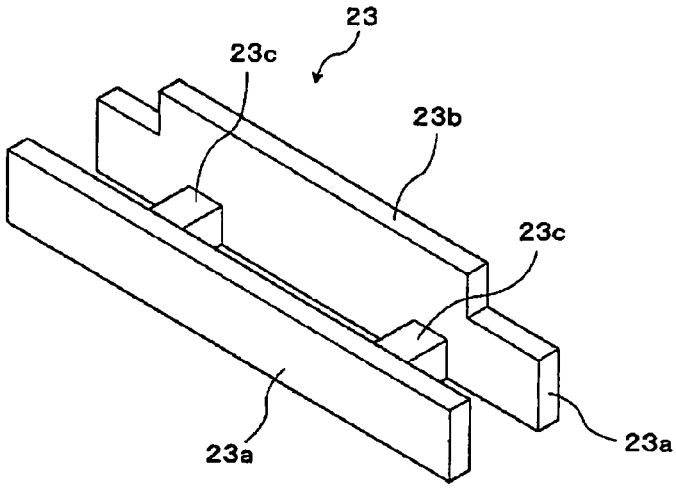
FIG. 9 is a perspective view of a foundation unit-use sliding resistive element as a modified example.

That is, the foundation unit 12 shown in FIG. 8 has the same fundamental structure as that of the foundation unit 12 of the preceding second alternate embodiment, but the foundation unit-use sliding resistive element 23 is modified. As shown in FIGS. 8(*a*) to (*c*) and FIG. 9, the foundation unit-use sliding resistive element 23 is formed to have a frame shape in plain view (opening in up and down directions) by placing a plurality (two, in the third alternate embodiment) of constrained units 23*a* and 23*a* of which the lower portion is formed in identical shape in intervals in the front and back directions and linking the both constrained units 23*a* and 23*a* via a pair of left and right link bodies 23*c* and 23*c*. At the same time, in the foundation unit-use sliding resistive element 23, the constraining unit 23*b* forming the upper portion is formed in the back-side constrained unit 23*a* and the constraining-layer forming material is filled in a space formed between the opposing constrained units 23*a* and 23*a*, thereby forming an intermediate-portion constraining layer 6.

In this way, within the space formed between the opposing constrained units 23*a* and 23*a*, the constraining-layer forming material is filled to form the intermediate-portion constraining layer 6. Thus, the constraining-layer forming material can be caused to more effectively exert the passive earth pressure Pp, as a reaction force.

That is, as shown in FIG. 8(*d*), by increasing a constraining pressure in the constraining-layer forming materials filled between the opposing, front and back constrained units 23*a* and 23*a*, the generation and development of the passive collapse slip surface Ss of the constraining-layer forming material are suppressed, and by increasing the shearing force of the constraining-layer forming material, the passive earth pressure Pp is exerted, thereby enabling intensification of the sliding resistance R more effectively.

The foundation unit-use sliding resistive element 23 in which the two constrained units 23*a* and 23*a* are embedded in a linking state within the foundation-unit forming layer 1 has a function of exerting a passive earth pressure and a function as the foundation-unit-main-body forming piece 27 responsible for a supporting force (a function as a foundation block), which is a role inherent in the foundation unit 12 of the retaining wall 10.

On the left and right sides of the two constrained units 23*a* and 23*a* forming such a foundation unit-use sliding resistive element 23, the lowest-level retaining wall block 32 is directly mounted, and on top thereof, a required number of retaining wall blocks 32 are sequentially stacked one above another. In this way, the retaining wall unit 14 can be constructed.

Therefore, the foundation unit-use sliding resistive element 23 according to the third alternate embodiment can be used as a sliding resistive element (that also serves as the foundation block) in which the sliding resistive element and the foundation-unit-main-body forming piece 27, as the foundation block, are integrally formed. The constraining-layer forming material is filled in the interior of the foundation unit-use sliding resistive element 23 to form the intermediate-portion constraining layer 6, and at the same time, the constraining-layer forming material is filled in the exterior to form the front and rear constraining layers 24 and 25, thereby enabling the formation of the foundation-unit forming layer 1. In this way, the retaining wall unit 14 can be arranged directly on the foundation-unit forming layer 1.

As a result, a bed drilling depth does not require the height of the foundation unit-use sliding resistive element 23, and in addition, the direct height of the retaining wall 10 is inevitably lowered by that height, thereby decreasing the maximum earth pressure and increasing a sliding safety factor. Moreover, the building construction of the retaining wall 10 is also simplified, resulting in an inexpensively construction.

When the backward constrained unit 23*a* and the constraining unit 23*b* lengthening upwardly from the constrained unit 23*a* are placed at a substantially center portion of the lowest-level retaining wall block 32, directly mounted on the foundation-unit forming layer 1, i.e., at a substantially intermediate position between the front wall 33 and the back wall 34, and thereby, the earth pressure acted on the backward constrained unit 23*a* and the constraining unit 23*b* is mitigated and the maximum earth pressure is acted on the lowest-level retaining wall block 32.

Note that the front-side constrained unit 23*a* preferably is positioned near the front wall 33 of the retaining wall block 32 mounted on the foundation-unit forming layer 1, i.e., proximately placed so that an interval therebetween is smaller than the grain size of the constraining-layer forming material filled within the retaining wall block 32.

Moreover, the structure of the foundation unit-use sliding resistive element 23 can be applied also to the structure of the boundary-use sliding resistive element 30 or the retaining wall unit-use sliding resistive element 40. In this case, the left and right widths of the constrained unit are so formed that they can be placed between the left and right side walls 85 and 86 (or between the left and right side walls 35 and 36 of the retaining wall block 32) of the foundation-unit-main-body forming piece 27, and at the same time, the left and right widths of the constraining unit is so formed that they are equal to or narrower than that of the constrained unit.

[Fourth Alternate Embodiment of the Foundation Unit 12]

Subsequently, with reference to FIG. 10, a fourth alternate embodiment of the foundation unit 12 will be described.

Figure 10:
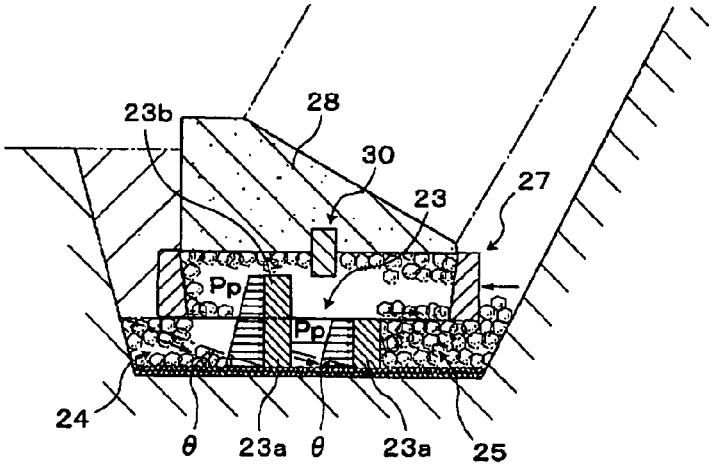
FIG. 10 is an explanatory diagram of the foundation unit as a fourth alternate embodiment.

That is, the foundation unit 12 shown in FIG. 10 has fundamentally the same structure of that of the foundation unit 12 in the second alternate embodiment. However, the foundation unit-use sliding resistive element 23 is modified. The foundation unit-use sliding resistive element 23 is formed to have a frame shape in plain view (opening in up and down directions) by placing a plurality (two, in the third alternate embodiment) of constrained units 23*a* and 23*a* of which the lower portion is formed in identical shape in intervals in the front and back directions and linking the both constrained units 23*a* and 23*a* via a pair of left and right link bodies 23*c* and 23*c*. At the same time, in the foundation unit-use sliding resistive element 23, the constraining unit 23*b* forming the upper portion is formed in the front-side constrained unit 23*a* and the constraining-layer forming material is filled in a space formed between the opposing constrained units 23*a* and 23*a*, thereby forming the intermediate-portion constraining layer 6.

In this way, within the space formed between the opposing constrained units 23*a* and 23*a*, the constraining-layer forming material is filled to form the intermediate-portion constraining layer 6. Thus, the constraining-layer forming material can be caused to more effectively exert the passive earth pressure, as a reaction force.

That is, by increasing a constraining pressure in the constraining-layer forming materials filled between the opposing, front and back constrained units 23*a* and 23*a*, the generation and development of the passive collapse slip surface Ss of the constraining-layer forming material are suppressed, and by increasing the shear resistance and the passive earth pressure Pp of the constraining-layer forming material, thereby enabling intensification of the sliding resistance more effectively.

On the foundation-unit forming layer 1, the foundation-unit-main-body forming piece 27 or foundation block is mounted, on the constraining-layer forming material filled within the foundation-unit-main-body forming piece 27, the foundation-unit-formation solidifying piece 28 is formed via the boundary-use sliding resistive element 30, and on the foundation-unit-formation solidifying piece 28, the retaining wall block 32 or a lattice block, etc., are installed fixedly.

Moreover, the structure of the foundation unit-use sliding resistive element 23 can be applied also to the structure of the boundary-use sliding resistive element 30 or the retaining wall unit-use sliding resistive element 40. In this case, the left and right widths of the constrained unit are so formed that they can be placed between the left and right side walls 85 and 86 (or between the left and right side walls 35 and 36 of the retaining wall block 32) of the foundation-unit-main-body forming piece 27, and at the same time, the left and right widths of the constraining unit are so formed that they are equal to or narrower than that of the constrained unit.

Note that in the fourth alternate embodiment, the constraining unit 23*b* of the foundation unit-use sliding resistive element 23 can form its upper portion in the back-side constrained unit 23*a* instead of forming its upper portion in the front-side constrained unit 23*a*.

[Fifth Alternate Embodiment of the Foundation Unit 12]

Subsequently, with reference to FIG. 11, a fifth alternate embodiment of the foundation unit 12 will be described.

Figure 11:
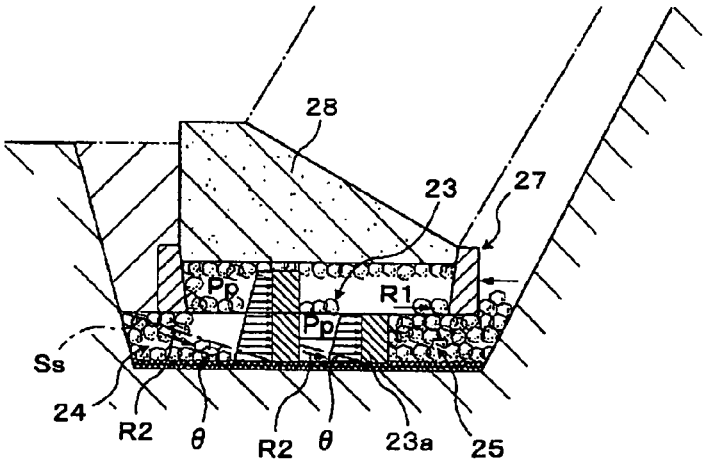
FIG. 11 is an explanatory diagram of the foundation unit as a fifth alternate embodiment.

That is, the foundation unit 12 shown in FIG. 11 is a modified example of the above-described fourth alternate embodiment, and has fundamentally the same structure as that in the fourth alternate embodiment. However, the different is that on the foundation-unit-main-body forming piece 27 mounted on the foundation-unit forming layer 1, the foundation-unit-formation solidifying piece 28 is integrally formed.

Note that in the fifth alternate embodiment, the constraining unit 23*b* of the foundation unit-use sliding resistive element 23 can form its upper portion in the back-side constrained unit 23*a* instead of forming its upper portion in the front-side constrained unit 23*a*.

[Sixth Alternate Embodiment of the Foundation Unit 12]

Figure 12A:
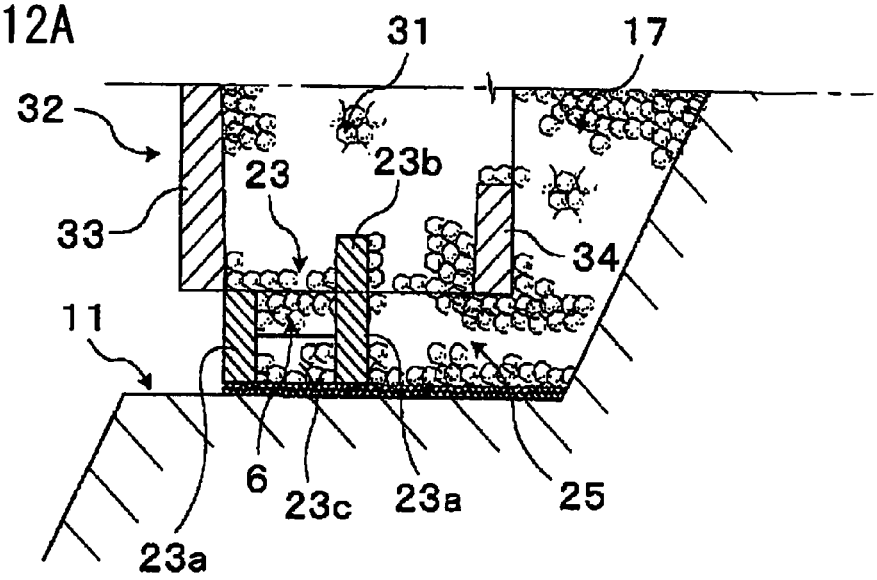
FIGS. 12(*a*) and 12(*b*) are explanatory diagrams of the foundation unit as a sixth alternate embodiment (FIG. 12(*a*) being a cross-sectional side surface view and FIG. 12(*b*) being a dynamic explanatory view).
Figure 12B:
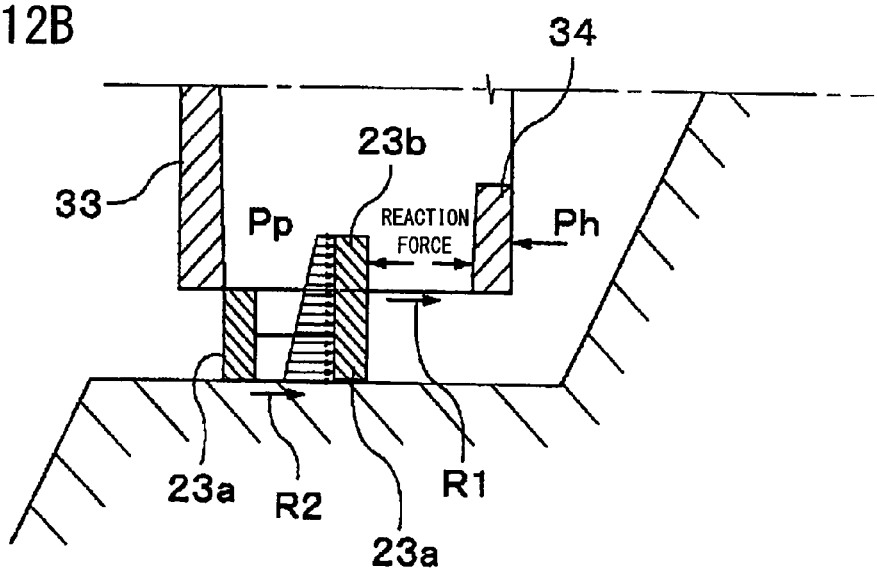

Subsequently, with reference to FIG. 12, a sixth alternate embodiment of the foundation unit 12 will be described.

That is, in the foundation unit 12 shown in FIG. 12, the retaining wall 10 in which the safety is secured is constructed as follows: when it is difficult to apply earth to be refilled at the front surface of the retaining wall 10, i.e., in a geography where a ground excavation for embedding a foundation unit is impossible, a trench 20 is not formed in the foundation ground 11, or the earth to be refilled is not applied to the front surface of the retaining wall block 32 (or the foundation-unit-main-body forming piece 27) mounted on the foundation-unit forming layer 1, but the foundation-unit forming layer 1 that has fundamentally the same structure as that of the foundation-unit forming layer 1 in the third alternate embodiment is formed on the foundation ground 11.

Then, when placing the retaining wall block 32 (or the foundation-unit-main-body forming piece 27) on the foundation-unit forming layer 1, the front wall 33 (or the front side 83) of the retaining wall block 32 (or the foundation-unit-main-body forming piece 27) is placed proximately at the substantially same position as that of the front-side constrained unit 23*a* forming one portion of the foundation-unit forming layer 1. In this way, it becomes possible to hold, without collapsing, the constraining-layer forming material forming the intermediate-portion constraining layer 6 between the constrained units 23*a* and 23*a*. As a result, the constraining-layer forming material can be caused to steadily exert the passive earth pressure Pp as the reaction force R. Therefore, in this case also, an effect similar to that in the third alternate embodiment can be obtained.

[First Alternate Embodiment of the Retaining Wall Unit-Use Sliding Resistive Element 40]

Subsequently, with reference to FIG. 13, another embodiment of the retaining wall unit-use sliding resistive element 40 will be described.

Figure 13A:
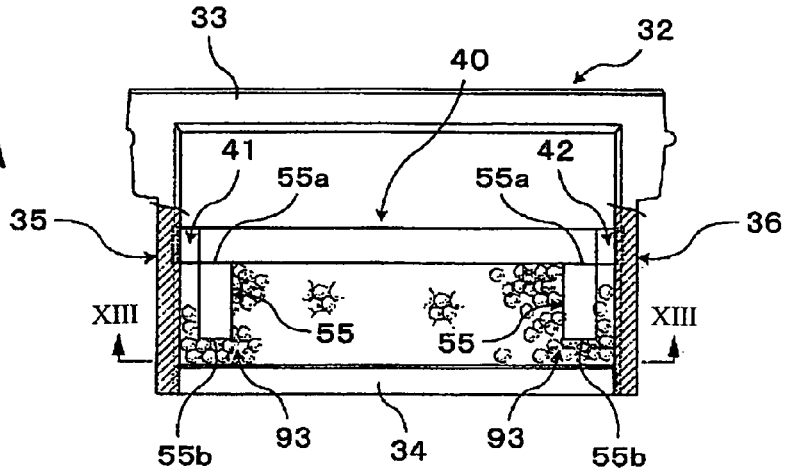
FIGS. 13(*a*) to 13(*c*) are explanatory diagrams of a usage situation of the retaining wall unit-use sliding resistive element as the first alternate embodiment (FIG. 13(*a*) being a plan explanatory diagram, FIG. 13(*b*) being a cross-sectional view taken along a line XIII-XIII of FIG. 13(*a*), and FIG. 13(*c*) being a cross-sectional side surface explanatory diagram).
Figure 13B:
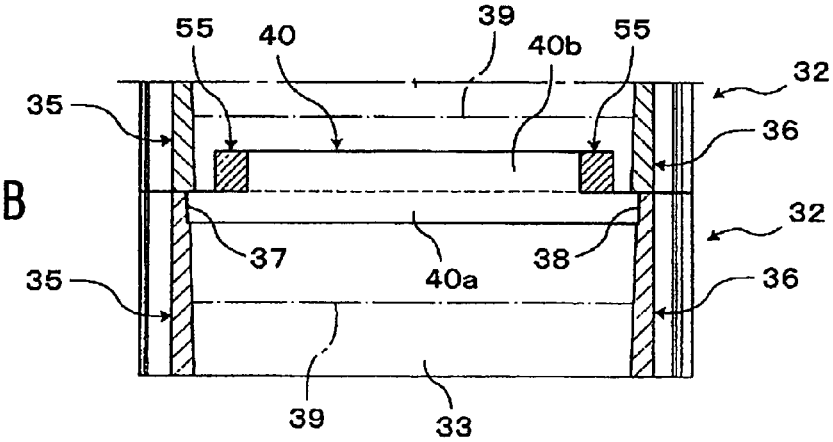
Figure 13C:
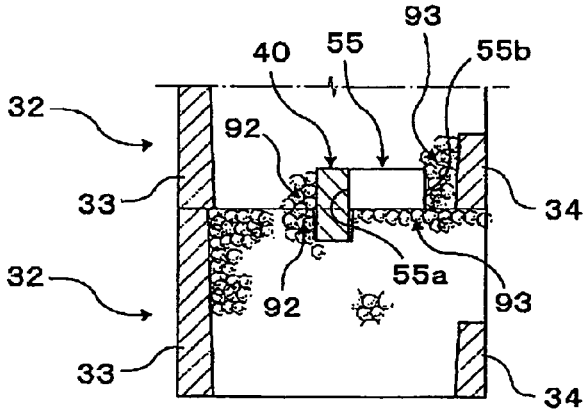

That is, as shown in FIG. 13, when a front-to-back interval between the front wall 33 and the back wall 34 of the retaining wall block 32 is large, a pair of left and right expanded sliding resistive elements 55 and 55 can be placed between the back wall 34 and the constraining unit 40*b* of the retaining wall unit-use sliding resistive element 40.

Each of the expanded sliding resistive elements 55 is formed in a square plate shape lengthening backward such that its left and right widths are substantially the same in front-to-back width (thickness) of the constraining unit 40*b* and that its height is substantially the same as the constraining unit 40*b*.

A front end surface 55*a* of the expanded sliding resistive element 55 is caused to touch the back surface of the constraining unit 40*b* and mounted on the internally filled material 31. In this way, a back end surface 55*b* of the expanded sliding resistive element 55 is placed proximately to the back wall 34 of the upper-level retaining wall block 32.

In this way, when the back end surface 55*b* of the expanded sliding resistive element 55 is placed proximately to the back wall 34 of the upper-level retaining wall block 32, the rear constraining layer 93 can be formed by filling the internally filled material 31 between the back end surface 55*b* and the back wall 34 of the retaining wall block 32. Thus, the forward sliding force can be steadily acted on the constraining unit 40*b* of the retaining wall unit-use sliding resistive element 40 via the expanded sliding resistive element 55.

As a result, even when a span between the constraining unit 40*b* of the retaining wall unit-use sliding resistive element 40 and the back wall 34 of the upper-level retaining wall block 32 is large, the sliding preventive function realized by the retaining wall unit-use sliding resistive element 40 can be secured.

[Second Alternate Embodiment of the Retaining Wall Unit-Use Sliding Resistive Element 40]

Subsequently, with reference to FIG. 14, a second alternate embodiment of the retaining wall unit-use sliding resistive element 40 will be described.

Figure 14A:
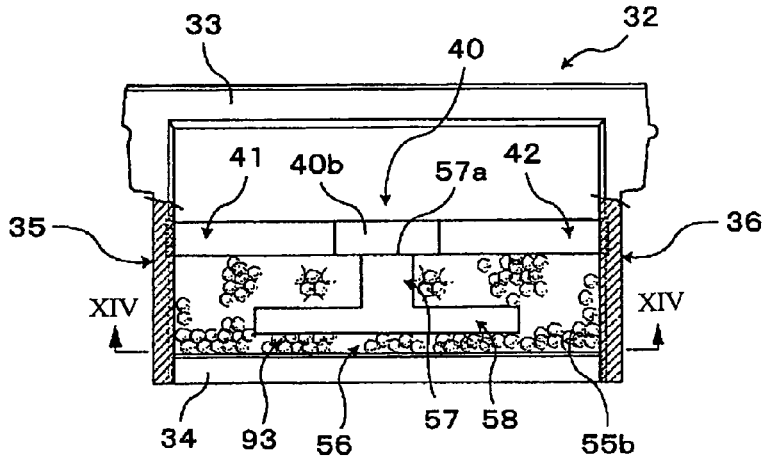
FIGS. 14(*a*) to 14(*c*) are explanatory diagrams of a usage situation of the retaining wall unit-use sliding resistive element as the second alternate embodiment (FIG. 14(*a*) being a plan explanatory diagram, FIG. 14(*b*) being a cross-sectional view taken along a line XIV-XIV of FIG. 14(*a*), and FIG. 14(*c*) being a cross-sectional side surface explanatory diagram).
Figure 14B:
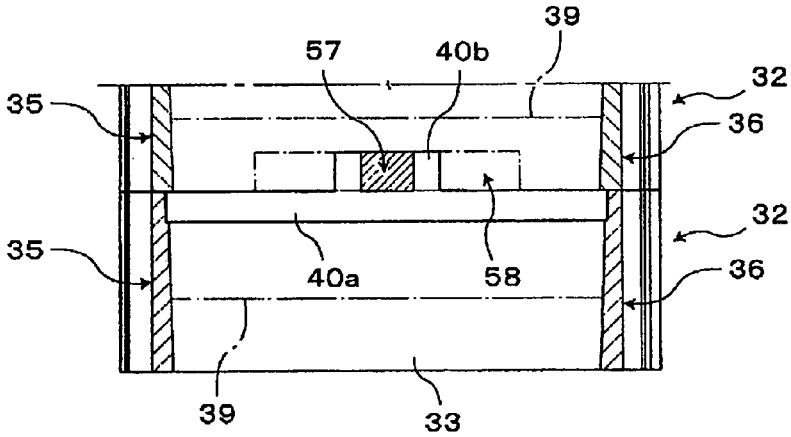
Figure 14C:
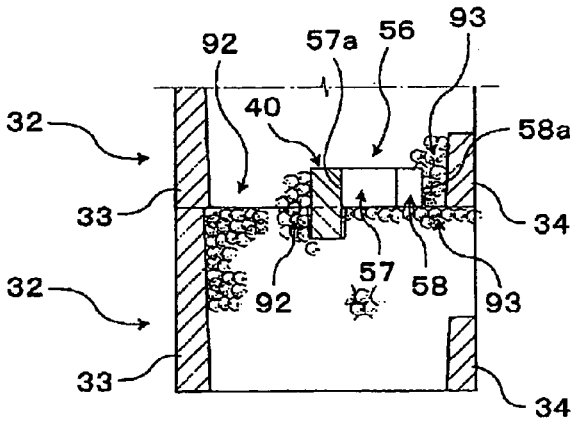

That is, as shown in FIG. 14, an expanded sliding resistive element 56 is a modified example of the expanded sliding resistive element 55. The expanded sliding resistive element 56 is formed in a substantially reverse T shape by a front-and-back direction lengthening piece 57 formed in a plate shape lengthening in the front and back directions and a left-and-right direction lengthening piece 58 formed in a plate shape lengthening in the left and right directions, and similarly to the expanded sliding resistive element 55, is placed between the back wall 34 of the retaining wall block 32 and the constraining unit 40*b* of the retaining wall unit-use sliding resistive element 40.

The expanded sliding resistive element 56 is mounted on the internally filled material 31 by causing the front end surface 57*a* of the front-and-back direction lengthening piece 57 to touch the back surface of the constraining unit 40*b*, and at the same time, placing the back surface 58*a* of the left-and-right direction lengthening piece 58 proximately to the back wall 34 of the upper-level retaining wall block 32.

In this way, when the back surface 58*a* of the left-and-right direction lengthening piece 58 is placed proximately to the back wall 34 of the upper-level retaining wall block 32, the rear constraining layer 93 can be formed by filling the internally filled material 31 between the back surface 58*a* and the back wall 34 of the retaining wall block 32. Thus, the forward sliding force can be steadily acted on the constraining unit 40*b* of the retaining wall unit-use sliding resistive element 40 via the expanded sliding resistive element 56.

At this time, the expanded sliding resistive element 56 can greatly form the area of the back surface 58*a* of the left-and-right direction lengthening piece 58, which serves as a receiving surface of the internally filled material 31, and thus, the sliding preventive function realized by the retaining wall unit-use sliding resistive element 40 can be secured more greatly than that realized by the expanded sliding resistive element 55.

[Third Alternate Embodiment of the Retaining Wall Unit-Use Sliding Resistive Element 40]

Subsequently, with reference to FIG. 15, another embodiment of a disposing position (attaching position) of the retaining wall unit-use sliding resistive element 40 will be described.

Figure 15:
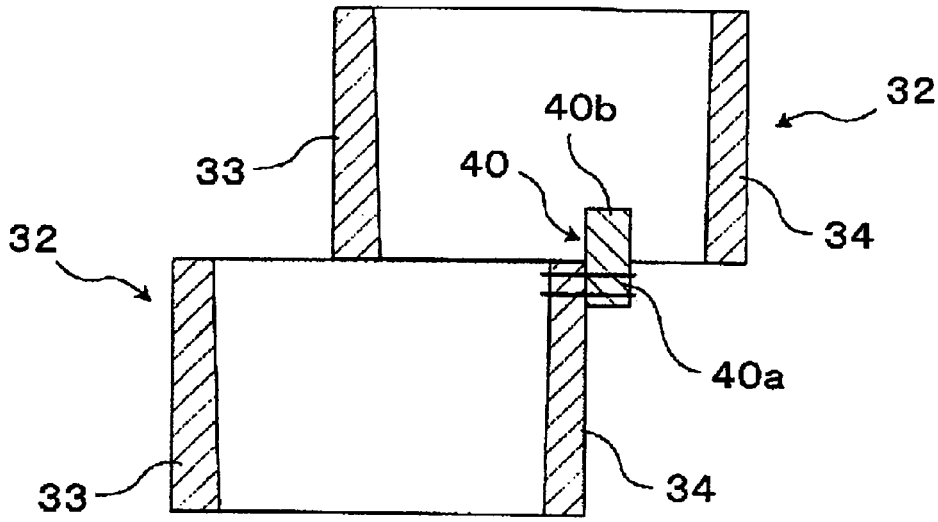
FIG. 15 is a cross-sectional side surface view showing a position of attaching the retaining wall unit-use sliding resistive element as the third alternate embodiment.

That is, as shown in FIG. 15, the heights of the front wall 33 and the back wall 34 of the retaining wall block 32 are formed substantially identically, and the upper portion of the back wall 34 is attached with the lower portion or constrained unit 40*a* of the retaining wall unit-use sliding resistive element 40 from behind so that these portions are linked. Herein, the constrained unit 40*a* of the retaining wall unit-use sliding resistive element 40 is embedded in the filled backfill material 17. Note that a manner in which the constrained unit 40*a* is linked to the lower-level retaining wall block 32, and then, embedded in the filled backfill material 17, whilst the constraining unit 40*b* is placed between the front and back walls 33 and 34 of the upper-level retaining wall block 32 is not limited to the above-described structure.

In this way, when the constraining unit 40*b* of the retaining wall unit-use sliding resistive element 40 is placed proximately to the back wall 34 of the upper-level retaining wall block 32, the forward sliding force can be acted on the constraining unit 40*b* of the retaining wall unit-use sliding resistive element 40.

[Fourth Alternate Embodiment of the Retaining Wall Unit-Use Sliding Resistive Element 40]

Subsequently, with reference to FIG. 16, still another embodiment of the disposing position (attaching position) of the retaining wall unit-use sliding resistive element 40 will be described.

Figure 16:
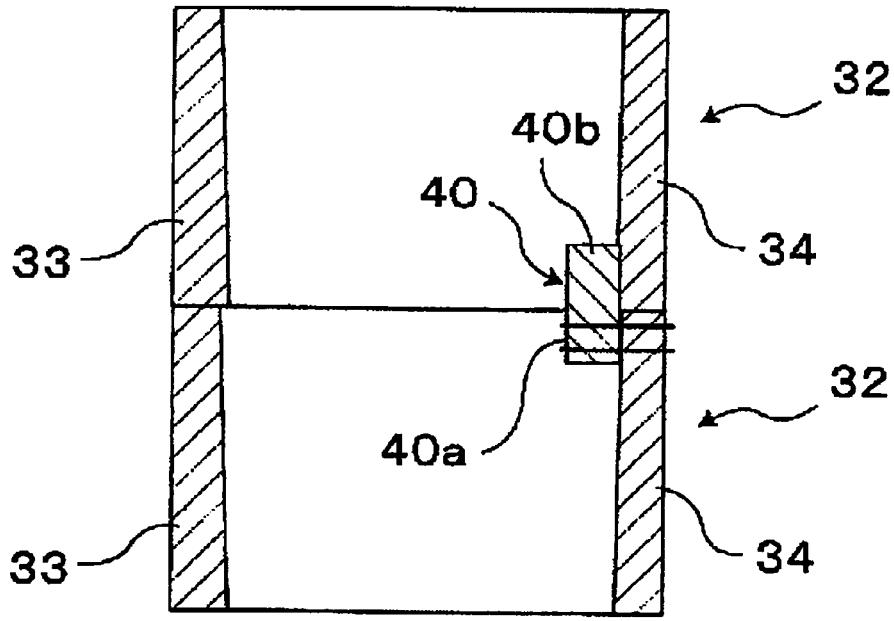
FIG. 16 is a cross-sectional side surface view showing a position of attaching the retaining wall unit-use sliding resistive element as the fourth alternate embodiment.
Figure 17A:
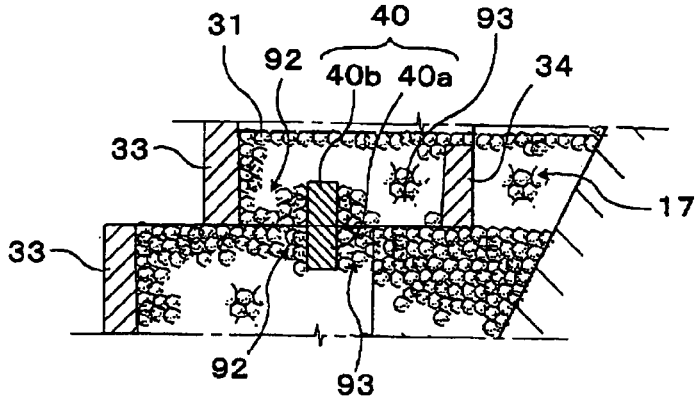
FIGS. 17(*a*) to 17(*d*) are explanatory diagrams of a boundary and a retaining wall unit as another embodiment.
Figure 17B:
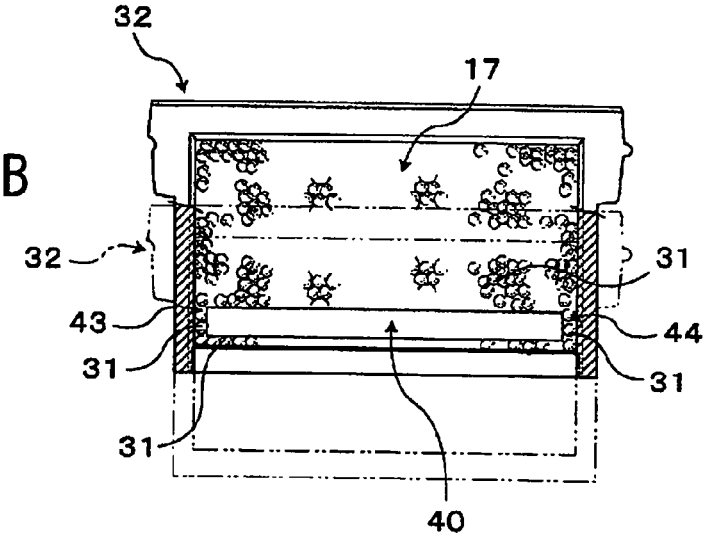
Figure 17C:
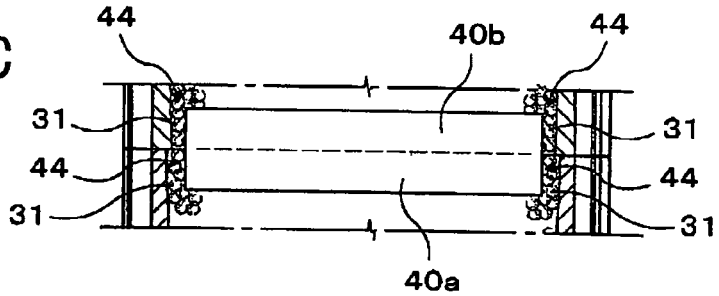
Figure 17D:
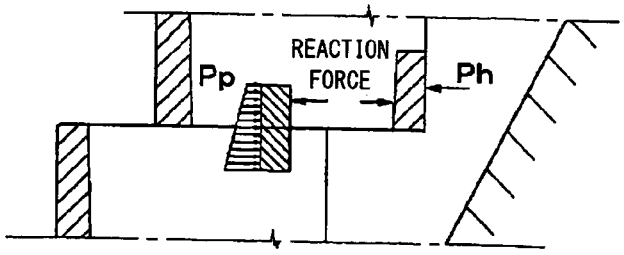

That is, as shown in FIG. 16, the heights of the front wall 33 and the back wall 34 of the retaining wall block 32 are formed substantially identically, and the upper portion of the back wall 34 is attached with the lower portion or constrained unit 40*a* of the retaining wall unit-use sliding resistive element 40 from inward so that these portions are linked.

In this way, when the constraining unit 40*b* of the retaining wall unit-use sliding resistive element 40 is caused to touch the back wall 34 of the upper-level retaining wall block 32, the forward sliding force can be steadily acted on the constraining unit 40*b* of the retaining wall unit-use sliding resistive element 40.

It may be also possible that the back wall 34 of the retaining wall block 32 is upwardly lengthened and the retaining wall unit-use sliding resistive element 40 is integrally molded, thereby bringing the constrained unit 40*a* in a state of being integrally linked to the retaining wall block 32, and the constraining unit 40*b* of the retaining wall unit-use slide preventing body 40 is placed between the front wall 33 and the back wall 34 of the retaining wall block 32 mounted at an upper level, whereby the front constraining layer 92 is formed at the front side of the constraining unit 40*b* and the back constraining layer 93 is formed at the back side thereof.

[Another Embodiment of the Boundary 13 and the Retaining Wall Unit 14]

Subsequently, with reference to FIG. 17, another embodiment of the boundary 13 or the retaining wall unit 14 in the first embodiment will be described.

In the boundary 13 of the first embodiment, the left and right side walls 85 and 86 of the foundation-unit-main-body forming piece 27 are linked by laterally disposing the boundary-use sliding resistive element 30 via the fitting-use concave units 87 and 88. However, the other embodiment is so configured that the boundary-use sliding resistive element 30 is not linked to the foundation-unit-main-body forming piece 27.

That is, the boundary-use sliding resistive element 30 is mounted on the foundation-unit-formation solidifying piece 28 without fitting the left and right side ends to the fitting-use concave units 87 and 88, and constrains the sliding in the front and back directions by means of the front constraining layer 90 and the rear constraining layer 91 formed by filling and rolling-compacting the internally filled material 31 as the constraining-layer forming material.

Moreover, in the retaining wall unit 14 of the first embodiment, the left and right side walls 35 and 36 of the retaining wall block 32 are linked by laterally disposing the boundary-use sliding resistive element 40 via the fitting-use concave units 37 and 38. However, as shown in FIG. 17(*a*), the other embodiment is so configured that the retaining wall unit-use sliding resistive element 40 is not linked to the retaining wall block 32, and at the position of upper and lower boundary surfaces of the respective upper and lower-level retaining wall blocks 32 (formed by stacking one above another), the retaining wall unit-use sliding resistive element 40 is placed over the lower-level retaining wall block 32 side and the upper-level retaining wall block 32 side.

That is, the retaining wall unit-use sliding resistive element 40 is mounted on the internally filled material 31 or constraining-layer forming material (that is rolling-compacted to a certain mid point) without fitting the left and right side ends to the fitting-use concave units 37 and 38, and the internally filled material 31 is thereafter filled and rolling-compacted to the upper end surface of the retaining wall block 32, thereby forming the front constraining layer 92 between the front wall 33 of the retaining wall block 32 and the constrained unit 40*a* of the retaining wall unit-use sliding resistive element 40 and also forming the rear constraining layer 93 between the constrained unit 40*a* of the retaining wall unit-use sliding resistive element 40 and the back wall 34. Thus, by using the front constraining layer 92 and the rear constraining layer 93, the sliding of the boundary-use sliding resistive element 40 in the front and back directions is constrained.

The constraining unit 40*b* of the retaining wall unit-use sliding resistive element 40 is placed between the front wall 33 and the back wall 34 of the retaining wall block 32 that is mounted on the upper level, and in this way, at the front side of the constraining unit 40*b*, the front constraining layer 92 by the internally filled material 31 is formed, and at the same time, at the back side thereof, the rear constraining layer 93 by the internally filled material 31 is formed. This configuration is similar to that in the first embodiment.

In this way, at the positions of upper and lower boundary surfaces of the upper and lower-level retaining wall blocks 32 and 32, the upper and lower-level front constraining layers 92 and 92 are continued in the up and down directions, and at the same time, the upper an lower-level rear constraining layers 93 and 93 are continued in the up and down directions. Thus, the front constraining layers 92 and 92 continued in the up and down directions and the rear constraining layers 93 and 93 continued in the up and down directions exert a reaction force (passive) via the retaining wall unit-use sliding resistive element 40, thereby reinforcing the sliding resistance of the retaining wall block 32 on the upper and lower boundary surfaces.

Therefore, as shown in FIG. 17(*d*), when the active earth pressure Ph, etc., are acted, as the sliding force, from behind on the back wall 34 of the upper-level retaining wall block 32, the sliding force is propagated from the back wall 34 of the upper-level retaining wall block 32→the internally filled material 31 forming the rear constraining layer 93→the retaining wall unit-use sliding resistive element 40, and as a result, the retaining wall unit-use slide preventing body 40 is moved forward very slightly. Thereby, the sliding force is propagated from the retaining wall unit-use sliding resistive element 40 to the internally filled material 31 (the constraining-layer forming material forming the front constraining layers 92 and 92 continued in the up and down directions) on the front side. Substantially simultaneously of this propagation, the internally filled material 31 on the front surface side of the retaining wall unit-use sliding resistive element 40 exerts the passive earth pressure Pp, as a reaction force, on the retaining wall unit-use sliding resistive element 40, thereby steadily preventing the sliding in the front direction of the upper-level retaining wall block 32.

Moreover, when it is assumed that due to an earthquake, etc., an external force is acted from forward, as the sliding force, on the front wall of the upper-level retaining wall block 32, the sliding force is propagated from the front wall 33 of the upper-level retaining wall block 32→the internally filled material 31 forming the front constraining layer 92→the sliding resistive element. When the sliding resistive element is moved backward very slightly, the sliding force is propagated from the retaining wall unit-use sliding resistive element 40 to the internally filled material 31 (the constraining-layer forming material forming the rear constraining layers 93 and 93 continued in the up and down directions) on the back surface side. Substantially simultaneously of this propagation, the internally filled material 31 on the back surface side of the retaining wall unit-use sliding resistive element 40 exerts the passive earth pressure Pp, as a reaction force, on the retaining wall unit-use sliding resistive element 40, thereby steadily preventing the sliding of the upper-level retaining wall block 32 in the back direction.

In this way, at the boundary between the upper and lower-level blocks 32 and 32, the front constraining layer 92 and the rear constraining layer 93 are respectively formed on the front and back surface sides of the constrained unit 40*a* of the retaining wall unit-use sliding resistive element 40, and at the same time, the front constraining layer 92 and the rear constraining layer 93 are respectively formed on the front and back surface sides of the constraining unit 40*b* of the retaining wall unit-use sliding resistive element 40. Thereby, the internally filled material 31 of the upper-level front and rear constraining layers 92 and 93 and the lower-level front and rear constraining layers 92 and 93 are mutually interlocked, thereby steadily preventing the sliding in front and back directions of the upper-level block 32 with respect to the lower-level block 32.

Moreover, the constrained unit 40*a* of the retaining wall unit-use sliding resistive element 40 is not linked to the lower-level retaining wall block 32, but the constrained unit 40*a* of the retaining wall unit-use sliding resistive element 40 is constrained by means of the internally filled material 31 forming the lower-level constraining layer. Thus, the internally filled materials 31 of the upper-level left and right side constraining layers 43 and 44 and the lower-level left and right side constraining layers 43 and 44 formed at the upper and lower-level boundaries are mutually interlocked, and thereby, the passive earth pressure Pp, as a reaction force, is exerted in the left (right) direction. As a result, the sliding of the upper-level retaining wall block 32 in the left (right) direction with respect to the lower-level block 32 is steadily prevented.

Note that the retaining wall unit-use sliding resistive element 40 may sometimes be mounted on the backfill material 17 (that is rolling-compacted to a certain mid point) behind the lower-level retaining wall block 32. In such a case, the internally filled material 31 is filled and rolling-compacted within the retaining wall block 32 to a position of the upper end surface of the retaining wall block 32 and the backfill material 17 as the constraining-layer forming material is filled and rolling-compacted behind the internally filled material 31 in a collective manner, and thereby, the front, back, left, and right constraining layers 92,93,43, and 44 made of the backfill material 17 are formed on the front, back, left, and right sides of the constrained unit 40*a* of the retaining wall unit-use sliding resistive element 40. On top of these layers, the upper-level retaining wall block 32 is mounted, and at the same time, between the front wall 33 and the back wall 34 of the retaining wall block 32, the constraining unit 40*b* of the retaining wall unit-use sliding resistive element 40 is placed.

Then, on the front, back, left, and right sides of the constraining unit 40*b*, the front, back, left, and right constraining layers 92, 93, 43, and 44 made of the internally filled material 31 are formed. In this state, the internally filled material 31 of the both front and rear constraining layers 92 and 93 of the upper and lower boundaries and the internally filled material 31 of the both left and right constraining layers 43 and 44 are mutually interlocked. As a result, the passive earth pressure Pp as a reaction force is exerted in the front, back, left and right directions, thereby steadily preventing the sliding of the upper-level retaining wall block 32 in the front and back directions and in the left and right directions.

[Retaining Wall as a Second Embodiment]

Figure 18:
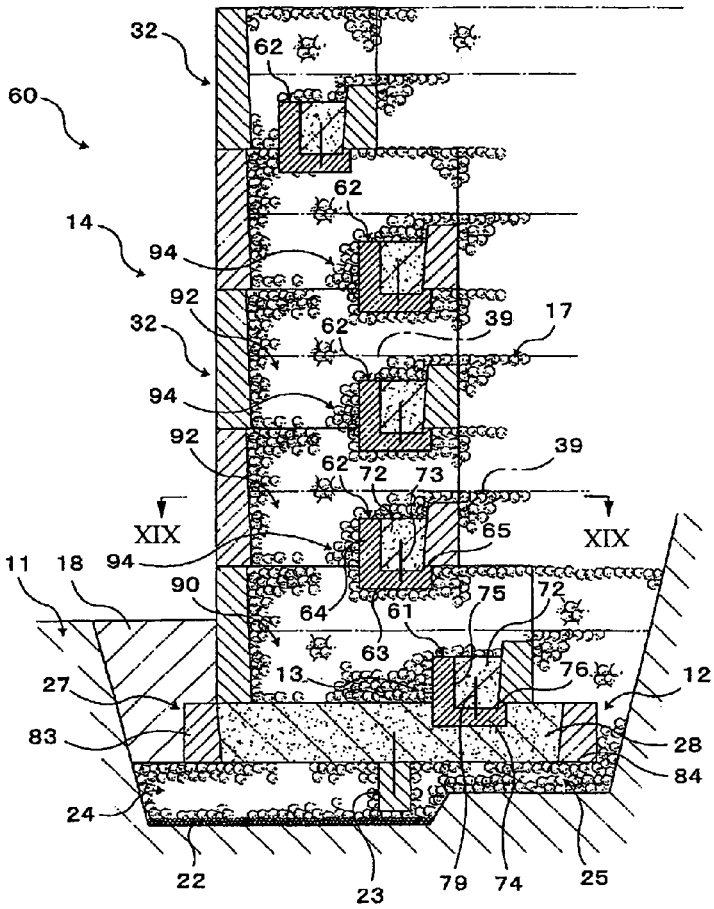
FIG. 18 is an explanatory diagram of a cross-sectional side surface of a retaining wall as a second embodiment.

Reference numeral 60 shown in FIG. 18 denotes a retaining wall or vertical wall, as a second embodiment. The retaining wall 60 has fundamentally the same structure as that of the retaining wall 10 as the first embodiment. The retaining wall 60 differs from the retaining wall 10 in that a boundary-use consecutively installed-type sliding resistive element 61 and a retaining wall unit-use consecutively installed-type sliding resistive element 62 are arranged so as to resolve a weak point on a falling-off surface of the vertical wall (this function is provided in addition to the sliding preventive function).

Figure 19:
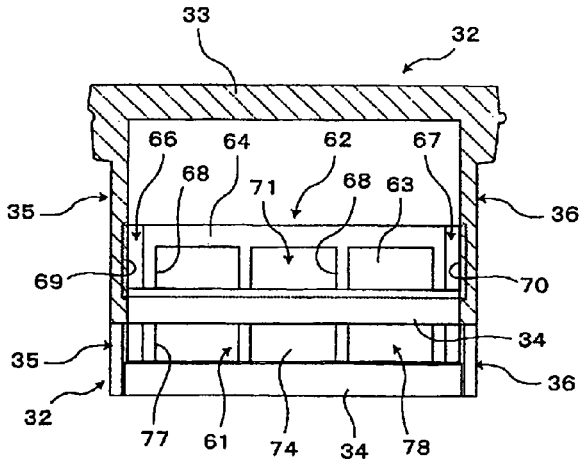
FIG. 19 is a cross-sectional plan view taken along a line XIX-XIX of FIG. 18.

As shown in FIG. 19, the boundary-use consecutively installed-type sliding resistive element 61 laterally disposed between the left and right side walls 85 and 86 of the foundation-unit-main-body forming piece 27, and the retaining wall unit-use consecutively installed-type sliding resistive element 62 disposed laterally between the left and right side walls 35 and 36 of the retaining wall block 32 have fundamentally the same structure. Thus, the structure of the retaining wall unit-use consecutively installed-type sliding resistive element 62 will be specifically described.

That is, the retaining wall unit-use consecutively installed-type sliding resistive element 62, as shown in FIG. 19, is formed in a substantially L-letter shape viewed in lateral side, and formed by: a plate-like bridging unit 63, having a quadrangled horizontally long end surface, lengthening in the retaining-wall elongating direction, a plate-like constraining unit 64 upwardly erecting from the front-end edge of the bridging unit 63, and a ridge 65 upwardly salient from the back-end edge of the bridging unit 63.

The constraining unit 64 is so formed that its left and right widths are narrower than those of the constrained unit 63, and forms interference-avoiding spaces 66 and 67 leftward and rightward of the constraining unit 64 and above the left and right side ends of the constrained unit 63, whereby the left and right sides constraining layers can be formed, similarly to the first embodiment.

In addition, in the consecutively installed-type sliding resistive element 62, a plurality (four, in the second embodiment) of partition walls 68 are formed in intervals in the left and right directions, thereby partitioning a space formed above the constrained unit 63 and behind the constraining unit 64 in a plurality of portions.

At an upper portion of the inner-side surface of the left and right side walls 35 and 36 of the retaining wall block 32, reverse-trapezoidal concave shaped fitting-use concave units 69 and 70, which open to above and on the inner side, are formed in a state to oppose in the left and right directions. The fitting-use concave units 69 and 70 are formed to be capable of being fit to the side end of the constrained unit 63 of the consecutively installed-type sliding resistive element 62, and between the left and right side walls 35 and 36, the beam 63 of the consecutively installed-type sliding resistive element 62 is disposed laterally via the fitting-use concave units 69 and 70.

The internally filled material 31 is filled within the retaining wall block 32 in the above state, thereby rolling-compacting the upper end surface of the retaining wall block 32 and the upper surface of the filled internally filled material 31 so that the both surfaces are substantially flush.

In such a state, the constrained unit 63 of the consecutively installed-type sliding resistive element 62 is embedded within the filled internally filled material 31. At the same time, the constraining unit 64 is upwardly salient from the upper surface of the filled internally filled material 31 whilst the upper end surface of the ridge 65 is substantially flush with the upper surface of the filled internally filled material 31, thereby securing the interference-avoiding spaces 66 and 67 leftward and rightward of the constraining unit 64.

On the retaining wall block 32 thus attached with the consecutively installed-type sliding resistive element 62, the separate retaining wall block 32 is mounted. At this time, between the front wall 33 and the back wall 34 of the upper-level retaining wall block 32, the constraining unit 64 of the consecutively installed-type sliding resistive element 62 attached to the lower-level retaining wall block 32 is placed, and at the same time, the lower surface of the back wall 34 of the upper-level retaining wall block 32 is brought into surface contact with the upper surface of the ridge 65 of the consecutively installed-type sliding resistive element 62 attached to the lower-level retaining wall block 32.

In this way, by the constrained unit 63, the constraining unit 64, the ridge 65, the partition wall 68 of the consecutively installed-type sliding resistive element 62, and the back wall 34 of the retaining wall block 32 stacked one above another at the immediately upper level, a plurality (four, in the second embodiment) of filled spaces 71 of which the upper surface opens are formed, and the solidification material 72 such as a concrete is filled in the filled spaces 71. At the same time, through the solidification, the consecutively installed-type slide preventing body 62, the retaining wall block 32 at the immediately upper level, and the retaining wall block 32 at the immediately lower level can be integrally consecutively installed by the solidification material 72. Reference numeral 73 is a fixor.

Moreover, as shown in FIG. 18 and FIG. 19, the boundary-use consecutively installed-type sliding resistive element 61 is formed by an embedded unit 74 (equivalent to the constrained unit 63 of the consecutively installed-type sliding resistive element 62), the constraining unit 75, the ridge 76, the partition wall 77, and the filled space 78, similarly to the retaining wall unit-use consecutively installed-type sliding resistive element 62. Reference numeral 79 is a fixor.

When the boundary-use consecutively installed-type sliding resistive element 61 is disposed laterally in the back portion within the foundation-unit-main-body forming piece 27, and at the same time, solidified by casting a cast in-situ concrete, etc., within the foundation-unit-main-body forming piece 27, the foundation-unit-formation solidifying piece 28 is formed, thereby embedding the embedded unit 74 within the foundation-unit-formation solidifying piece 28 for integration. At the same time, the constraining unit 75 is rendered upwardly salient whilst the upper end surface of the ridge 76 is substantially flush with the upper surface of the foundation-unit-formation solidifying piece 28.

In such a state, on the foundation-unit-formation solidifying piece 28, the retaining wall block 32 forming the lowest level of the retaining wall unit 14 is mounted, and between the front wall 33 and the back wall 34 of the retaining wall block 32, the constraining unit 75 is placed, and at the same time, the lower surface of the back wall 34 is brought into surface contact with the upper surface of the ridge 76.

In this way, by the embedded unit 74, the constraining unit 75, the ridge 76, and the partition wall 77 of the consecutively installed-type sliding resistive element 61, and the back wall 34 of the retaining wall block 32 forming the lowest level, a plurality of filled spaces 78 of which the upper surface opens are formed, the solidification material 72 such as a concrete is filled within the filled spaces 78, and at the same time, the solidification material 72 is solidified. Thereby, by the solidification material 72, the consecutively installed-type sliding resistive element 61, the retaining wall block 32 forming the lowest level, and the foundation-unit-formation solidifying piece 28 are integrally consecutively installed.

When the retaining wall 60 is constructed as described above, similarly to the retaining wall 10, a good sliding preventive function can be secured in the boundary between retaining wall blocks 94 formed between the upper and lower-level retaining wall blocks 32 and 32 of the foundation unit 12, the boundary 13, and the retaining wall unit 14.

In addition, when the retaining wall 60 receives the active earth pressure from the bedrock 15, in each retaining wall block 32 forming a linear wall, a momonet in which the back end side is pivoted counterclockwise in FIG. 18 by using the lower-end front-end edge as a fulcrum is generated. However, in the second embodiment, by means of the boundary-use consecutively installed-type sliding resistive element 61 and the retaining wall unit-use consecutively installed-type sliding resistive element 62, the respective retaining wall blocks 32 and 32 stacked one above another in the up and down directions are consecutively installed for a purpose of integration. Thus, these retaining wall block 32 are integrated to challenge the earth pressure of the bedrock 15.

Note that the second embodiment is so placed that between the consecutively installed-type sliding resistive elements 61 and 62 and the back wall 34 of the retaining wall blocks 32 stacked one above another toward the upper level, the filled space 71 is formed. However, it may also be so placed that the filled space 71 is formed between the consecutively installed-type sliding resistive elements 61 and 62 and the front wall 33 of the retaining wall block 32.

[First Modified Example of the Retaining Wall as a Second Embodiment]

Figure 20:
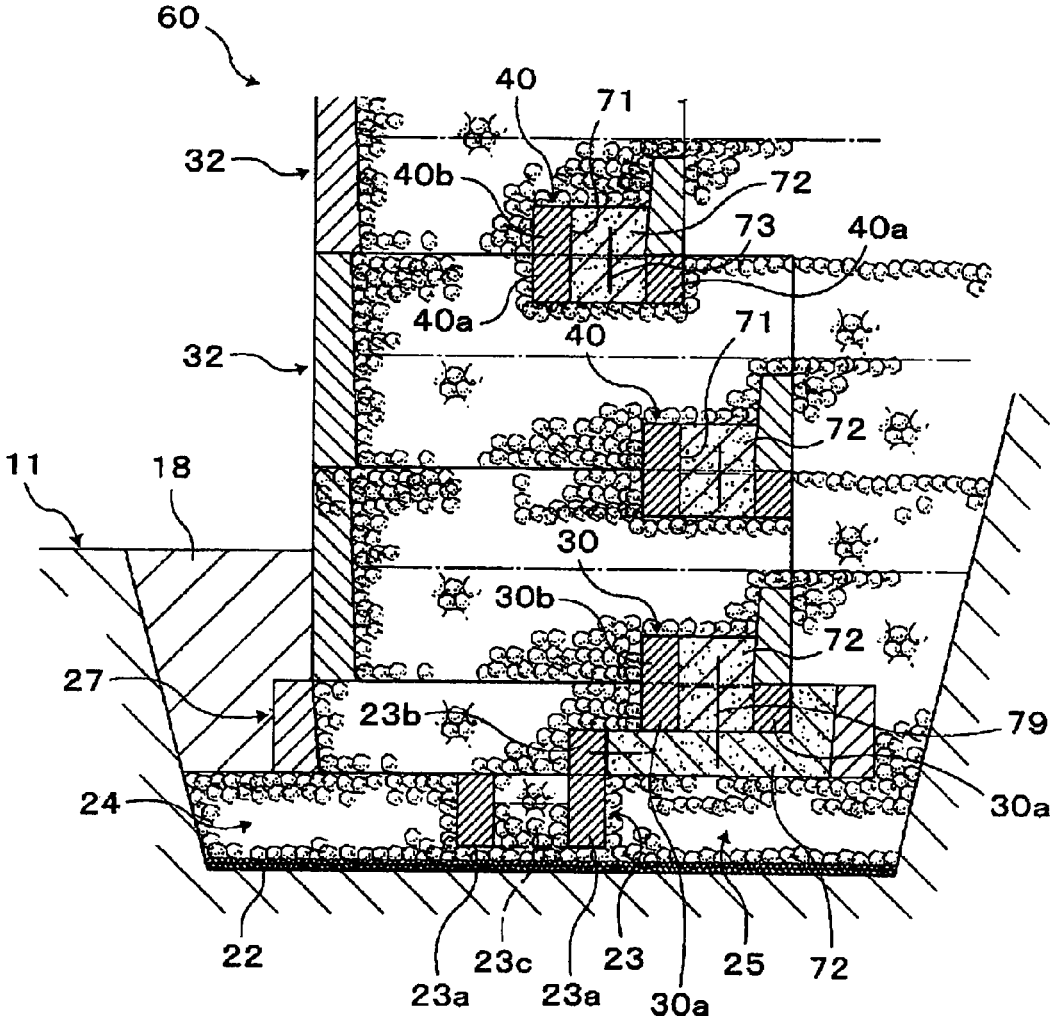
FIG. 20 is an explanatory diagram of a cross-sectional side surface of a retaining wall as a first modified example of the second embodiment.

FIG. 20 shows a first modified example of the retaining wall 60 as a second embodiment, in which the foundation unit-use sliding resistive element 23 described in the third alternate embodiment of the foundation unit 12 is adopted as the foundation unit-use sliding resistive element 23, and at the same time, the structure of the foundation unit-use sliding resistive element 23, instead of the consecutively installed-type sliding resistive elements 61 and 62, adopted in the sixth alternate embodiment of the foundation unit 12 is applied to the structure of the boundary-use sliding resistive element 30 and the retaining wall unit-use sliding resistive element 40.

Herein, the left and right widths of the constraining unit **23*b* are formed to be those capable of being placed between the left and right side walls 85 and 86 (or between the left and right side walls 35 and 36 of the retaining wall block 32) of the foundation-unit-main-body forming piece 27, and at the same time, the left and right widths of the constrained unit 23*a* are formed to be equal to or wider than those of the constraining unit 23*b***.

[Second Modified Example of the Retaining Wall as a Second Embodiment]

Figure 21:
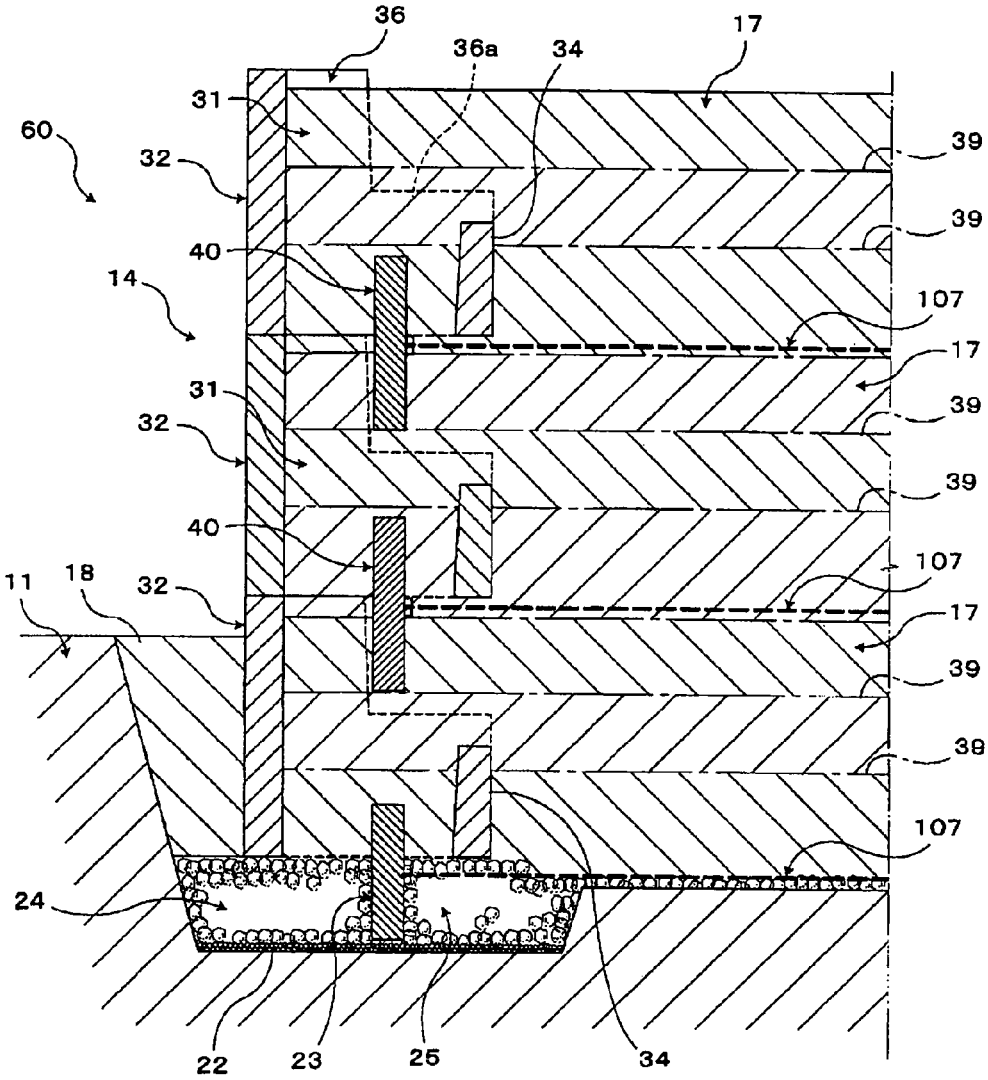
FIG. 21 is an explanatory diagram of a cross-sectional side surface of a retaining wall as a second modified example of the second embodiment.

FIG. 21 shows a second modified example of the retaining wall 60 as a second embodiment, in which the foundation unit-use sliding resistive element 23 described in the second alternate embodiment of the foundation unit 12 is adopted as the foundation unit-use sliding resistive element 23, and at the same time, the structure of the retaining wall unit-use sliding resistive element 40, instead of the consecutively installed-type sliding resistive elements 61 and 62, adopted in the boundary 13 or the retaining wall unit 14 as the other embodiment is applied.

Figure 22:
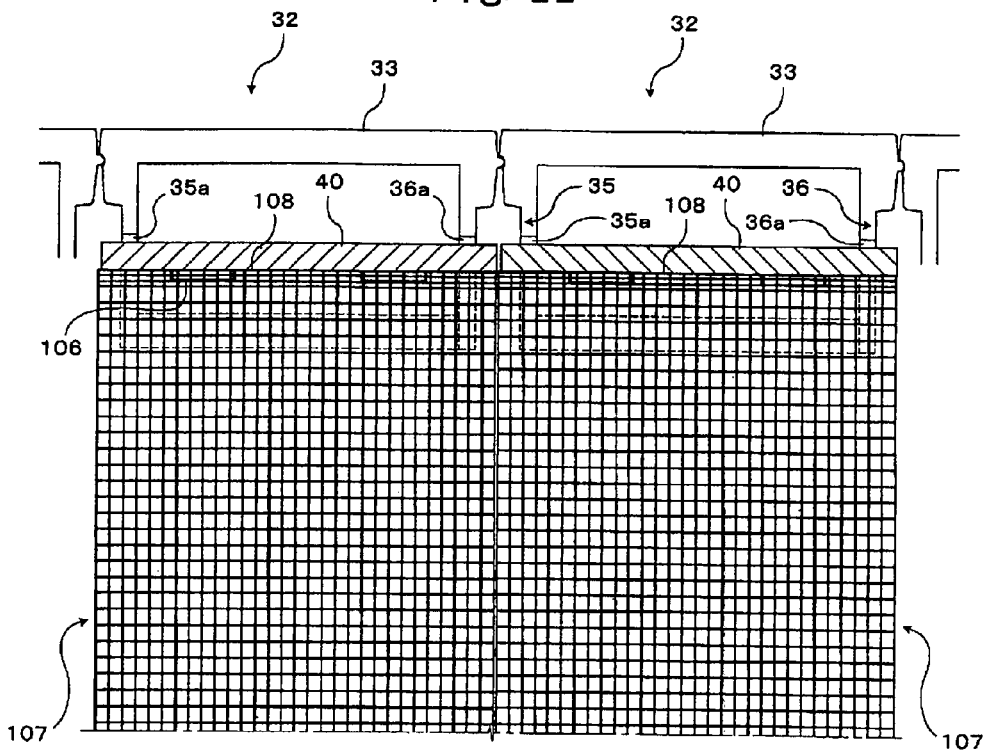
FIG. 22 is a plan explanatory diagram of the retaining wall.

In the retaining wall block 32, as is shown in FIG. 22, a latter half portion of the upper portion of the left and right side walls 35 and 36 is cutaway, and concave units with a step 35*a* and 36*a* are formed at a position above the back wall 34. In this way, between the concave units with a step 35*a* and 36*a*, the retaining wall unit-use sliding resistive element 40 formed to be a laterally-long quadrangled plate shape wider than an external side surface width of the left and right side walls 35 and 36 is placed in a transverse manner.

Figure 23:
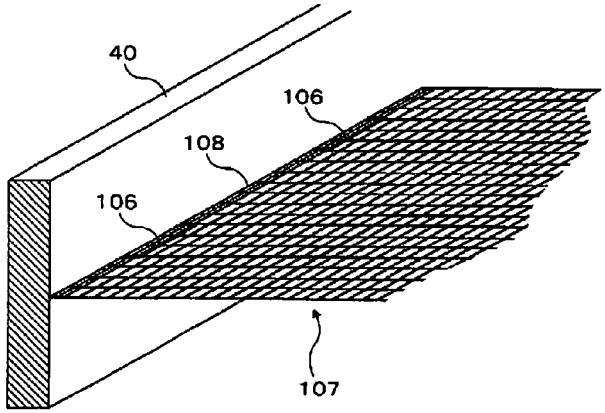
FIG. 23 is an explanatory perspective view of a linking state between a sliding resistive element and an anchorage.

In addition, as is shown in FIG. 23, to a back-surface halfway portion of each of the sliding resistive elements 23 and 40, a distal end edge 108 of the ribbon-shaped anchorage 107 is linked via a clamp 106, and at the same time, the anchorage 107 is so placed that its leading end is lengthened substantially horizontally in a ground (not shown) formed behind the retaining wall unit 14, and thus, the anchorage 107 is brought into a state of being embedded in the rear constraining layer 93, a backfill material layer formed by filling the backfill material 17, further, in the ground. Herein, for the anchorage 107, either a fabric material or a screen material can be selected as long as a required tensile force is provided.

In this way, each of the sliding resistive elements 23 and 40 is linked to the distal end edge 108 of the ribbon-shaped anchorage 107, which is substantially horizontally placed, in a state of being embedded in the rear constraining layer 93, the backfill material layer, and further, in the ground, and thus, in theory, along with a slight movement of the sliding resistive element 23 (40) by the active earth pressure, the tension stress occurs in the anchorage 107 itself linked to the sliding resistive element 23 (40), thereby reinforcing the shear resistance of the ground material. On the other hand, the retaining wall block 32 itself is able to surely prevent the retaining wall block 32 from sliding or falling off due to the reaction force (passive) produced, via the sliding resistive element 23(40), by the forming material of the both front constraining layers 92 and 92 of the upper and lower boundaries at each level.

In this way, by exerting the effective reaction force via the sliding resistive element 23 (40), a sliding preventive effect of preventing the sliding of the retaining wall block 32 and a ground strengthening effect of strengthening the ground material by linking the anchorage 107 to the sliding resistive element 23(40) can be organically integrated. As a result, the present invention can provide a strengthened earth wall construction method using a steadier anchorage 107.

[Third Modified Example of the Retaining Wall as a Second Embodiment]

Figure 24:
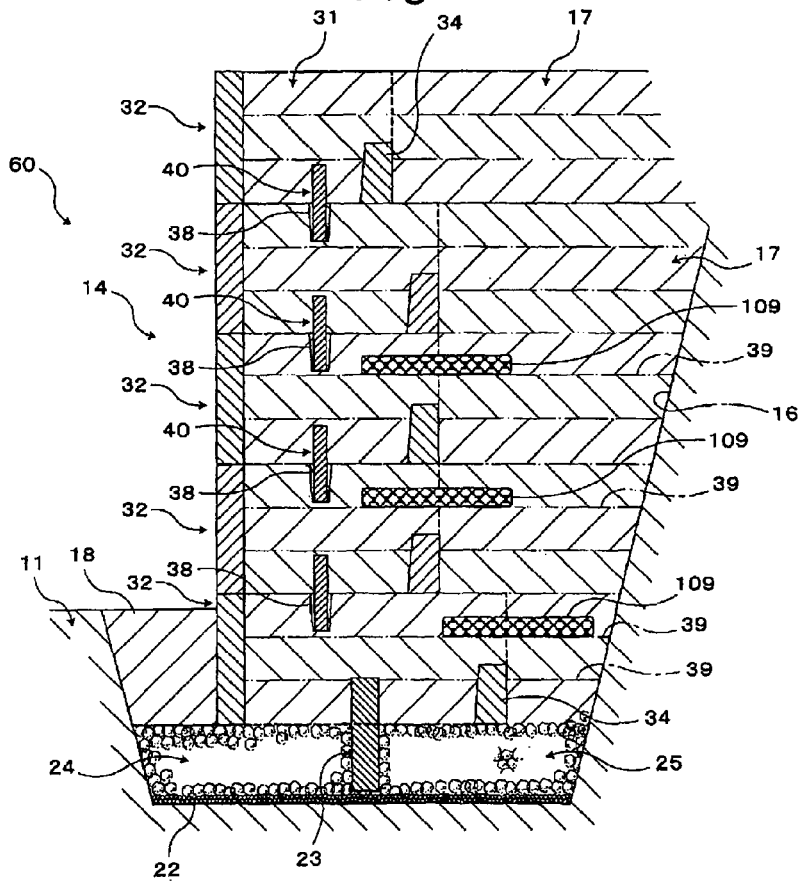
FIG. 24 is an explanatory diagram of a cross-sectional side surface of a retaining wall as a third modified example of the second embodiment.

FIG. 24 shows a third modified example of the retaining wall 60 as the second embodiment, in which the foundation unit-use sliding resistive element 23, as the foundation unit-use sliding resistive element 23, described in the second alternate embodiment of the foundation unit 12, is adopted, and at the same time, the structure of the retaining wall unit-use sliding resistive element 40, instead of the consecutively installed-type sliding resistive elements 61 and 62, adopted in the structure of the retaining wall unit 14 in the first embodiment is applied.

Figure 25:
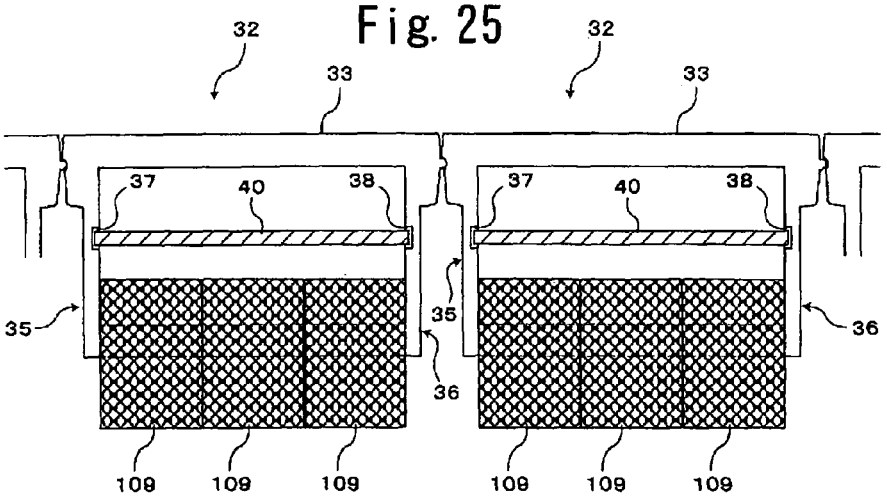
FIG. 25 is a plan explanatory diagram of the retaining wall.

Herein, as shown in FIG. 25, between the left and right side walls 35 and 36 of each of the retaining wall blocks 32, the retaining wall unit-use sliding resistive elements 40 are disposed laterally via the fitting-use concave units 37 and 38. Each of the retaining wall unit-use sliding resistive elements 40 is placed on the same imaginary line lengthening in the up and down directions.

At a position immediately above the back wall 34 of the retaining wall block 32, a sandbag 109 formed by filling a grain-sized material such as a gravel and crushed stone is disposed. In the third modified example, on a rolling-compaction line 39 formed by rolling-compacting the internally filled material 31 or the backfill material 17 at a position slightly above the upper end of the back wall 34, the sandbag 109 is mounted over the front and back of the back wall 34, and at the same time, the internally filled material 31 or the backfill material 17 is filled and rolling-compacted on the resultant sandbag 109 so that it is in a state of being embedded.

In this way, on the each back wall 34 of each of the lower level-side retaining wall blocks 32, the sandbag 109 is mounted or loaded, thereby preventing the retaining wall 60 from forwardly falling off.

[Retaining Wall as a Third Embodiment]

Figure 26:
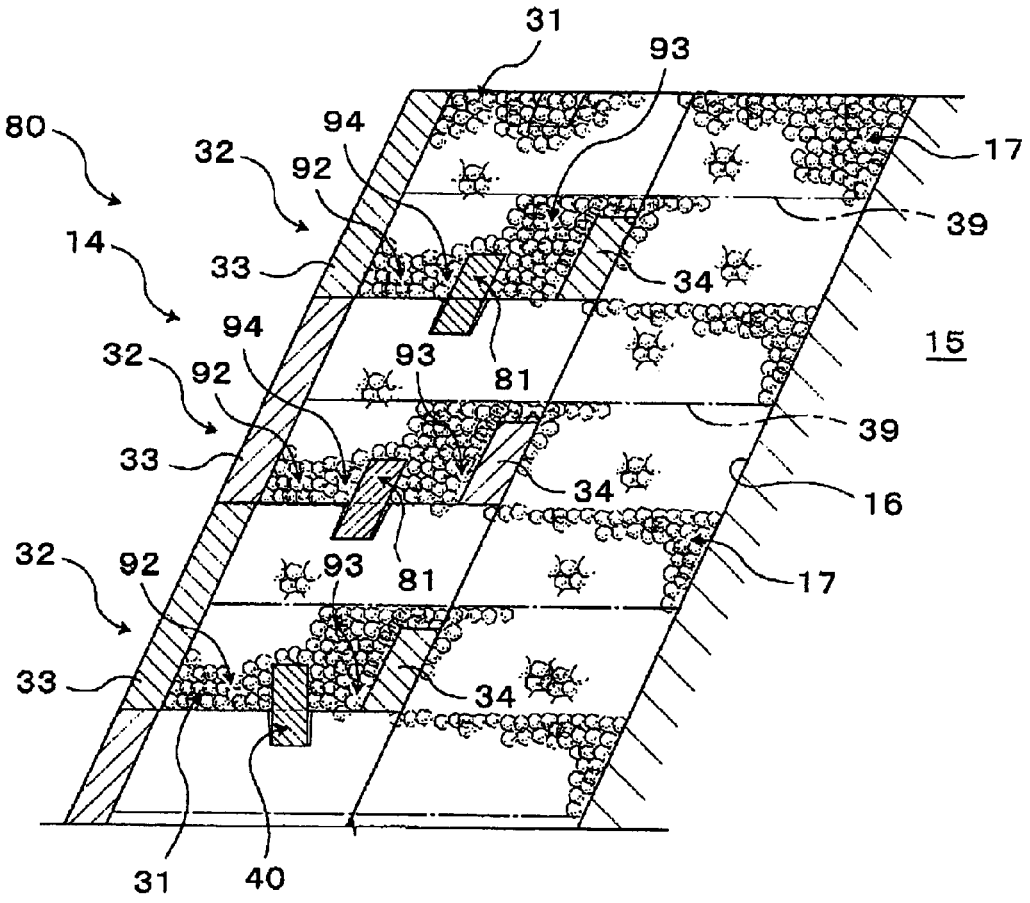
FIG. 26 is an explanatory diagram of a cross-sectional side surface of one portion of a retaining wall as a third embodiment.

FIG. 26 shows one portion of the retaining wall 80 which is an obliquely stacked retaining wall, as a third embodiment. In the retaining wall 80, the front wall 33 and the back wall 34 forming the retaining wall block 32 is formed in such a backwardly inclined state that the front side is low and the back side is high.

In such a retaining wall block 32, the retaining wall-use sliding resistive element 81 having fundamentally the same structure as that of the retaining wall-use sliding resistive element 40 in the first embodiment is attached. The retaining wall-use sliding resistive element 81 is attached in such an inclined state so as to be substantially parallel to the front and back walls 33 and 34 of the retaining wall block 32 to be attached.

In this way, also by such a retaining wall-use sliding resistive element 81, similarly to the retaining wall-use slide preventing body 40 of the first embodiment, the sliding preventive function is effected.

Note that the respective sliding resistive elements 30, 40, 61, 62, and 81 adopted in the retaining walls 10, 60, and 80 in the preceding first to third embodiments can be adopted, if required, in the retaining walls 10, 60, and 80 as another embodiment.

[Retaining Wall as a Fourth Embodiment]

Figure 27A:
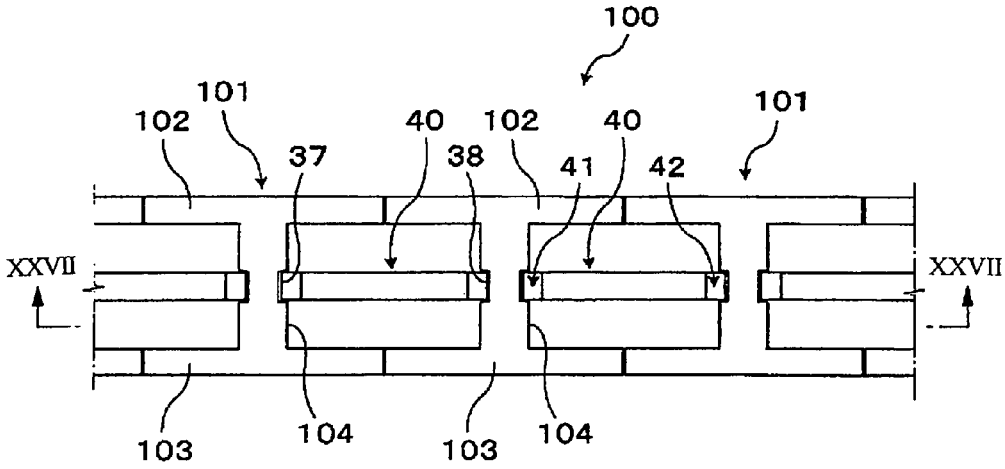
FIGS. 27(*a*) to 27(*b*) are explanatory diagrams of one portion of a retaining wall of a fourth embodiment (FIG. 27(*a*) being a plan explanatory diagram and FIG. 27(*b*) being a cross-sectional explanatory diagram taken along a line XXVII-XXVII of FIG. 27(*a*)).
Figure 27B:
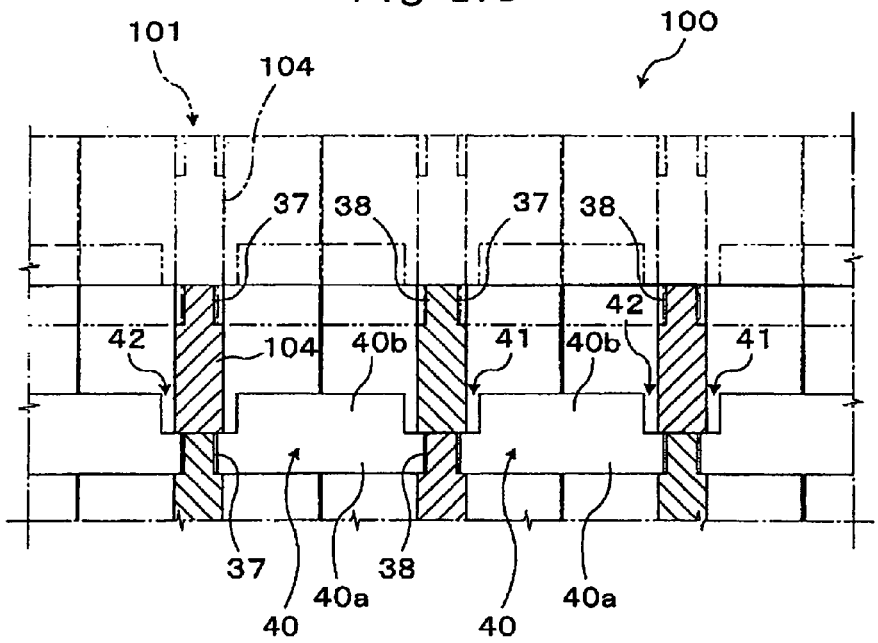

FIG. 27(*a*) is a plan explanatory diagram showing one portion of a retaining wall 100 as a fourth embodiment, and FIG. 27(*b*) is its cross-sectional explanatory diagram taken along a line V-V of FIG. 27(*a*). In the retaining wall 100, the retaining wall blocks 101 as bocks are constructed by stacking directly on top of one another (in a so-called "unbonded (or very simple)" stacking manner).

Each retaining wall block 101 is formed in a shape that resembles a letter "H" as viewed in plan by linking the front wall 102 and back wall 103 by a link wall 104 as a link body. On the left and right side surfaces of the link wall 104, fitting-use concave units 37 and 38 are so formed that they are positioned at a substantially center portion and at an upper portion. The fitting-use concave units 37 and 38 formed in another retaining wall block 101 adjacent leftward or rightward, i.e., the reverse-trapezoidal concave shaped fitting-use concave unit 37 and fitting-use concave unit 38, opposite to the left and right, are fitted to the left and right side ends of the retaining wall unit-use sliding resistive element 40, respectively, and between the link walls 104 and 104 adjacent to the left and right, the retaining wall unit-use slide preventing body 40 is laterally disposed.

In this way, between the link walls 104 and 104 of the retaining wall blocks 101 and 101 adjacent leftward and rightward, the internally filled material 31 (not shown) as the constraining-layer forming material is filled and rolling-compacted, and thereby, the retaining wall unit-use slide preventing body 40 fulfills a sliding preventive function similar to that in the retaining wall unit-use sliding resistive element 40 in the first embodiment.

Moreover, unlike in the retaining wall unit 14 as the other embodiment shown in FIG. 17, the retaining wall unit-use sliding resistive element 40 is not laterally disposed between the link walls 104 and 104 but is simply placed between the link walls 104 and 104. Thereby, the retaining wall unit-use sliding resistive element 40 can also fulfill the sliding preventive function similar to that of the retaining wall unit-use sliding resistive element 40 of the retaining wall unit 14 as the other embodiment shown in FIG. 17.

[Retaining Wall as a Modified Example of the Fourth Embodiment]

Figure 28A:
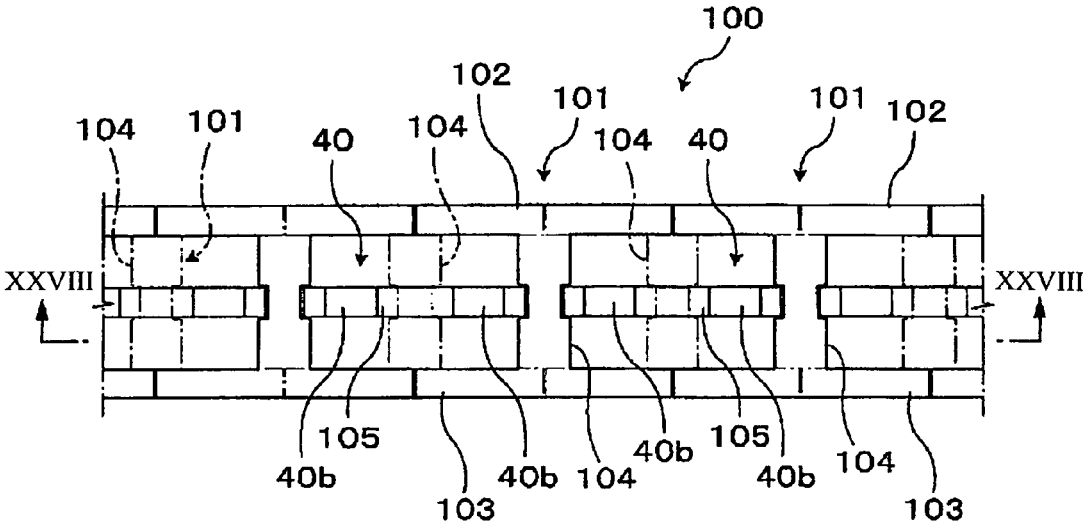
FIGS. 28(*a*) and 28(*b*) are explanatory diagrams of one portion of a retaining wall as a modified example of the fourth embodiment (FIG. 28(*a*) being a plan explanatory diagram and FIG. 28(*b*) being a cross-sectional explanatory diagram taken along a line XXVIII-XXVIII of FIG. 28(*a*)).
Figure 28B:
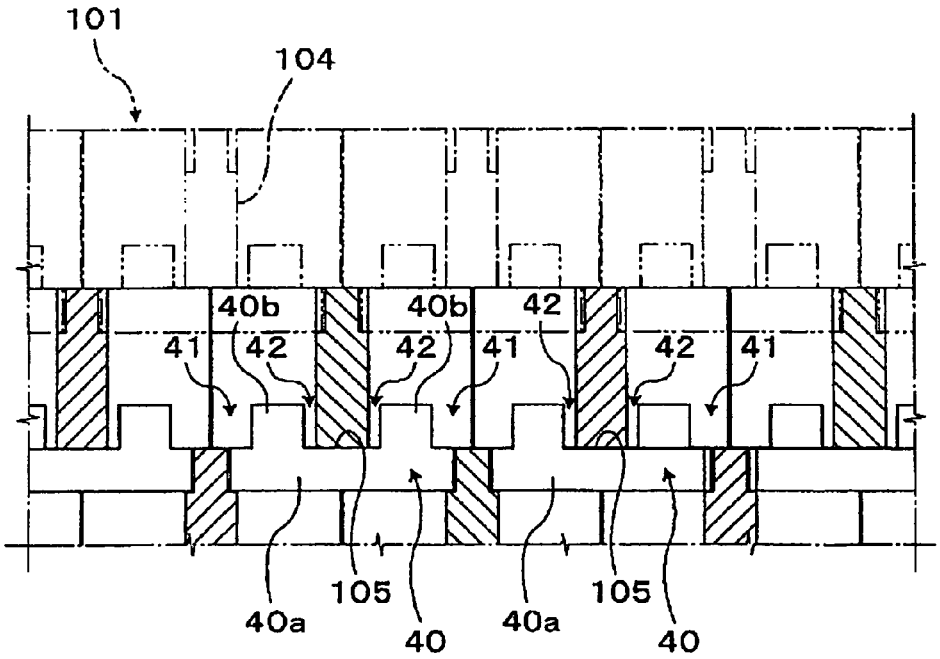

FIG. 28(*a*) is a plan explanatory diagram showing one portion of a retaining wall 100 as a modified example of the fourth embodiment and FIG. 28(*b*) is its cross-sectional explanatory diagram taken along a line VI-VI of FIG. 28(*a*). In the retaining walls 100, the retaining wall blocks 101 as blocks are constructed by staking directly on top of one another (in a so-called breaking joint system).

The fundamental structure of the present modified example is configured similarly to that in the fourth embodiment. However, the former differs from the latter in that at a center portion of the constraining unit 40*b* of the retaining wall unit-use sliding resistive element 40, the link wall placement-use concave unit 105 is formed, and the link wall 104 of each retaining wall block 101 stacked one above another on an upper level in a breaking joint manner is placed within the link wall placement-use concave unit 105 so as not to be interfered by the constraining unit 40*b*.

Between the side surface of the link wall 104 placed within the link wall placement-use concave unit 105 and the side end surface of the constraining unit 40*b*, interference-avoiding spaces 41 and 42 are formed. The internally filled material 31 (not shown) as the constraining-layer forming material is filled and rolling-compacted also within each of the interference-avoiding spaces 41 and 42, and further, between the side end surfaces of the constraining unit 40*b* of the retaining wall unit-use sliding resistive element 40 adjacent in the left and right directions, thereby forming the left and right side constraining layers.

In this way, between the link walls 104 and 104 of the retaining wall blocks 101 and 101 adjacent leftward and rightward, the internally filled material 31 (not shown) as the constraining-layer forming material is filled and rolling-compacted, and thereby, the retaining wall unit-use slide preventing body 40 fulfills a sliding preventive function similar to that in the retaining wall unit-use sliding resistive element 40 in the first embodiment.

Moreover, unlike in the retaining wall unit 14 as the other embodiment shown in FIG. 17, the retaining wall unit-use sliding resistive element 40 is not laterally disposed between the link walls 104 and 104 but is simply placed between the link walls 104 and 104. Thereby, the retaining wall unit-use sliding resistive element 40 can also fulfill the sliding preventive function similar to that of the retaining wall unit-use sliding resistive element 40 of the retaining wall unit 14 as the other embodiment shown in FIG. 17.

The present invention provides a simply structured foundation-unit structure capable of steadily reinforcing a sliding resistance, which is effective as a foundation-unit structure of a structural object such as a retaining wall, etc., being install fixedly on a foundation ground and receiving an external force such as an active earth pressure and an earthquake.

The invention claimed is:

1. A foundation-unit structure of a retaining wall placed on a foundation ground along a slope of a bedrock, the foundation-unit structure comprising:

a concave portion formed on the foundation ground, and a grain-sized material layer formed by filling the inside of the concave portion with a grain-sized material, an internal frictional angle of the grain-sized material forming the grain-sized material layer comprising a magnitude equal to or greater than that of an originally used ground material supporting the grain-sized material layer, a block comprising a link body connecting front and back walls of the block, the block being positioned on the grain-sized material layer, a lower portion of a sliding resistive element configured as a plate and being positioned within the grain-sized material layer such that the sliding resistive element opposedly faces the slope of the bedrock at a back side of the sliding resistive element, an upper portion of the sliding resistive element projecting upwardly from the grain-sized material layer between front and rear walls of a respective one of said blocks of a plurality of said blocks adapted to form the retaining wall such that the sliding resistive element is positioned over and between a boundary surface in a vertical direction between the grain-sized material layer of the concave portion and an adjacent block and between said adjacent block and an adjacent successive block, the sliding resistive element being positioned vertically with respect to a respective block such that the sliding resistive element and front and back walls of a respective block are not vertically aligned or contiguous with each other, and a front space and a back space being formed between the upper portion of the sliding resistive element and the front and back walls of the block, the front and the back spaces being filled with a grain-sized material so a to form a front constraining layer and a rear constraining layer so that the front constraining layer and portions of the grain-sized material layer filled in the concave portion formed on the foundation ground below the front constraining layer are integrally formed with each other in the vertical direction, whereby when an earth pressure is applied to a respective block, a passive reaction force is generated at a front surface of the sliding resistive element so as to provide increased sliding resistance of a respective block, the sliding resistive element being slidable with respect to the front and rear walls of a respective block so as to enable said sliding resistance.

2. A structure of upper and lower boundaries of a retaining wall so constructed that a foundation unit is disposed on a foundation ground along a slope of a bedrock and retaining wall units are placed on the foundation unit, wherein one or more of a block which forms a part of the foundation unit and a plurality of blocks which are formed by stacking the retaining wall units one above another each includes at least front and back walls and a link body for linking both the front and back walls, a sliding resistive element, shaped as a plate, is placed over a lower-level block side and an upper-level block side at upper and lower boundary surfaces of the respective upper and lower-level blocks formed by stacking separate blocks one above another, the sliding resistive element being positioned vertically with respect to a respective block and the bedrock so as to oppositely face each thereof such that the sliding resistive element and front and back walls of a respective block are not vertically aligned or contiguous with each other, a constraining-layer forming material comprising a grain-sized material is filled into a space formed between a front wall of the lower-level block and a portion of the sliding resistive element on the lower-level block side so as to form a front constraining layer on the lower-level block side, and a constraining-layer forming material comprising a grain-sized material is filled in a space formed between the portion of the sliding resistive element on the lower-level block side and a slope formed on a back wall of the lower-level block so as to be disposed behind a respective retaining wall unit so as to form a rear constraining layer on the lower-level block side, a constraining-layer forming material comprising a grain-sized material is filled in a space formed between the front wall of the upper-level block and the portion of the sliding resistive element on the upper-level block side so as to form a front constraining layer on the upper-level block side, and a constraining-layer forming material comprising a grain-sized material is filled in a space formed between the portion of the sliding resistive element on the upper-level block side and the back wall of the upper-level block so as to form a rear constraining layer on the upper-level block side, the upper and lower-level block front constraining layers are continuously formed so as to be integral with each other in a vertical direction and the upper and lower-level rear constraining layers are continuously formed so as to be integral with each other in the vertical direction at the upper and lower boundary surfaces of the upper and lower-level blocks, whereby when an earth pressure is applied to a respective block, a passive reaction force is generated at a front surface of the sliding resistive element so as to provide increased sliding resistance of a respective block, the sliding resistive element being slidable with respect to the front and rear walls of a respective block so as to enable said sliding resistance.

3. A retaining wall comprising a foundation unit disposed on the foundation ground according to claim 1, the retaining wall being constructed so that the foundation unit is disposed on the foundation ground along a slope of a bedrock and retaining wall units are placed on the foundation unit, wherein a sliding resistive element, shaped as a plate, is placed on the block in such a manner that the sliding resistive element extends over a lower-level block side and an upper-level block side at upper and lower boundary surfaces of the respective upper and lower-level blocks formed by stacking separate blocks each of which includes at least front and back walls and a link body for linking both the front and back walls on the block, the sliding resistive element being positioned vertically with respect to a respective block and the bedrock so as to oppositely face each thereof such that the sliding resistive element and front and back walls of a respective block are not vertically aligned or contiguous with each other, a constraining-layer forming material comprising a grain-sized material is filled into a space formed between a front wall of the lower-level block and a portion of the sliding resistive element on the lower-level block side so as to form a front constraining layer on the lower-level block side, and a constraining-layer forming material comprising a grain-sized material is filled in a space formed between the portion of the sliding resistive element on the lower-level block side and a slope formed on a back wall of the lower-level block so as to be disposed behind the retaining wall unit so as to form a rear constraining layer on the lower-level block side, a constraining-layer forming material comprising a grain-sized material is filled in a space formed between the front wall of the upper-level block and the portion of the sliding resistive element on the upper-level block side so as to form a front constraining layer on the upper-level block side, and a constraining-layer forming material comprising a grain-sized material is filled in a space formed between the portion of the sliding resistive element on the upper-level block side and the back wall of the upper-level block so as to form a rear constraining layer on the upper-level block side, the upper and lower-level front constraining layers are continuously formed so as to be integral with each other in the vertical direction and the upper and lower-level rear constraining layers are continuously formed so as to be integral with each other in the vertical direction at the upper and lower boundary surfaces of the upper and lower-level blocks, whereby when an earth pressure is applied to a respective block, a passive reaction force is generated at a front surface of the sliding resistive element so as to provide increased sliding resistance of a respective block, the sliding resistive element being slidable with respect to the front and rear walls of a respective block so as to enable said sliding resistance.

4. The retaining wall according to claim 3, wherein a distal end of a ribbon-shaped anchorage is linked with the sliding resistive element so as to be placed at the upper and lower boundary surfaces of the blocks, and a leading end of the anchorage is adapted to be extended substantially horizontally in a ground portion formed behind the retaining wall unit thus causing the anchorage to be embedded in the ground portion.

* * * * *